US008360667B2

(12) United States Patent
Sago

(10) Patent No.: US 8,360,667 B2
(45) Date of Patent: Jan. 29, 2013

(54) PRINTER

(75) Inventor: Akira Sago, Seto (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 485 days.

(21) Appl. No.: 12/718,129

(22) Filed: Mar. 5, 2010

(65) Prior Publication Data

US 2010/0316427 A1 Dec. 16, 2010

(30) Foreign Application Priority Data

Jun. 10, 2009 (JP) ..... 2009-139528
Jun. 10, 2009 (JP) ..... 2009-139565

(51) Int. Cl.
*B41J 35/28* (2006.01)
*B41J 32/00* (2006.01)
*B41J 35/36* (2006.01)
*B41J 3/36* (2006.01)

(52) U.S. Cl. ..... 400/207; 400/208; 400/242; 400/611

(58) Field of Classification Search ..... 400/76, 400/120.02, 201, 207, 208, 208.1, 242, 611, 400/615.2; 347/214
See application file for complete search history.

(56) References Cited

U.S. PATENT DOCUMENTS 4,127,883 A 11/1978 Mestdagh
4,567,488 A 1/1986 Moriguchi et al.
4,880,325 A * 11/1989 Ueda et al. ..... 400/249
4,892,425 A 1/1990 Shimizu et al.
4,915,516 A 4/1990 Shimizu et al.
4,927,278 A 5/1990 Kuzuya et al.
4,983,058 A 1/1991 Nagae
5,188,469 A 2/1993 Nagao et al.
5,203,951 A 4/1993 Hattori et al.
5,223,939 A 6/1993 Imaizumi et al.
RE34,521 E 1/1994 Shimizu et al.
5,277,503 A 1/1994 Nagao
(Continued)

FOREIGN PATENT DOCUMENTS

EP 0329369 A2 9/1992
EP 0511602 A1 1/1993
(Continued)

OTHER PUBLICATIONS

International Preliminary Report on Patentability in PCT/JP2009/071568 on Nov. 15, 2011.

(Continued)

*Primary Examiner* — Daniel J Colilla
*Assistant Examiner* — Marissa Ferguson Samreth
(74) *Attorney, Agent, or Firm* — McCarter & English, LLP

(57) ABSTRACT

A printer that includes a cassette housing portion into which a tape cassette is detachably installed in a vertical direction, a feeding device that feeds the tape mounted in the tape cassette, a printing head that performs printing on the tape, a platen roller that is located facing the printing head, a roller holder that rotatably supports the platen roller, a mechanical sensor having a switch terminal that is capable of protruding and retracting, a sensor holder that holds the mechanical sensor between the shaft of the roller holder and the platen roller and that is capable of moving independently of the roller holder between a third position and a fourth position, and a determination device that determines the type of the tape based on protrusion and retraction of the switch terminal.

18 Claims, 29 Drawing Sheets

U.S. PATENT DOCUMENTS

| | | | | |
|---|---|---|---|---|
| 5,348,406 | A | | 9/1994 | Yoshiaki et al. |
| 5,350,243 | A | | 9/1994 | Ichinomiya et al. |
| 5,374,132 | A | | 12/1994 | Kimura |
| 5,411,339 | A | | 5/1995 | Bahrabadi et al. |
| 5,419,648 | A | | 5/1995 | Nagao et al. |
| 5,429,443 | A | | 7/1995 | Kobayashi et al. |
| 5,466,076 | A | | 11/1995 | Kobayashi et al. |
| 5,494,362 | A | | 2/1996 | Kobayashi et al. |
| 5,538,352 | A | | 7/1996 | Sugiura |
| 5,540,510 | A | | 7/1996 | Sims et al. |
| 5,564,843 | A | | 10/1996 | Kawaguchi |
| 5,593,237 | A | | 1/1997 | Nozaki et al. |
| 5,620,268 | A | | 4/1997 | Yamaguchi et al. |
| 5,653,542 | A | | 8/1997 | Sugimoto et al. |
| 5,659,441 | A | | 8/1997 | Eckberg et al. |
| 5,727,888 | A | | 3/1998 | Sugimoto et al. |
| 5,730,536 | A | | 3/1998 | Yamaguchi |
| 5,771,803 | A | | 6/1998 | Takami |
| 5,813,773 | A | | 9/1998 | Kawai |
| 5,825,724 | A | | 10/1998 | Matsumoto et al. |
| 5,964,539 | A | | 10/1999 | Yamaguchi et al. |
| 6,042,280 | A | | 3/2000 | Yamaguchi et al. |
| 6,048,118 | A | * | 4/2000 | Martinez et al. ..... 400/208 |
| 6,059,469 | A | * | 5/2000 | Hirumi ..... 400/208 |
| 6,116,796 | A | | 9/2000 | Yamaguchi et al. |
| 6,132,120 | A | | 10/2000 | Yamaguchi et al. |
| 6,168,328 | B1 | | 1/2001 | Ueda et al. |
| 6,190,069 | B1 | | 2/2001 | Yamaguchi et al. |
| 6,196,740 | B1 | | 3/2001 | Yamaguchi et al. |
| 6,317,156 | B1 | | 11/2001 | Nagasaki et al. |
| 6,334,724 | B2 | | 1/2002 | Yamaguchi et al. |
| 6,406,202 | B1 | | 6/2002 | Unno et al. |
| 6,435,744 | B1 | | 8/2002 | Dunn et al. |
| 6,476,838 | B1 | | 11/2002 | Italiano |
| 6,485,206 | B1 | | 11/2002 | Takahashi |
| 6,520,696 | B2 | | 2/2003 | Huss et al. |
| 6,709,179 | B2 | | 3/2004 | Yamaguchi et al. |
| 7,121,751 | B2 | | 10/2006 | Harada et al. |
| 7,128,483 | B2 | | 10/2006 | Harada et al. |
| D534,203 | S | | 12/2006 | Harada et al. |
| D542,334 | S | | 5/2007 | Harada et al. |
| 7,965,308 | B2 | | 6/2011 | Jauert et al. |
| 8,045,288 | B2 | | 10/2011 | Ota et al. |
| 8,109,684 | B2 | | 2/2012 | Yamaguchi |
| 8,162,553 | B2 | | 4/2012 | Vandermeulen |
| 8,164,609 | B2 | | 4/2012 | Liu et al. |
| 2002/0006303 | A1 | | 1/2002 | Yamaguchi et al. |
| 2002/0012558 | A1 | | 1/2002 | Huss et al. |
| 2002/0047063 | A1 | | 4/2002 | Kaneda et al. |
| 2004/0233269 | A1 | | 11/2004 | Tsubota |
| 2005/0172981 | A1 | | 8/2005 | Byun |
| 2006/0204304 | A1 | | 9/2006 | Hioki et al. |
| 2006/0233582 | A1 | | 10/2006 | Horiuchi |
| 2006/0239743 | A1 | | 10/2006 | Naito |
| 2007/0009306 | A1 | | 1/2007 | Harada et al. |
| 2007/0041772 | A1 | | 2/2007 | Harada et al. |
| 2007/0070168 | A1 | | 3/2007 | Mindler et al. |
| 2007/0237562 | A1 | | 10/2007 | Kato et al. |
| 2008/0050160 | A1 | | 2/2008 | Yamaguchi et al. |
| 2008/0080922 | A1 | | 4/2008 | Vandermeulen |
| 2008/0181708 | A1 | | 7/2008 | Yamaguchi et al. |
| 2008/0226373 | A1 | | 9/2008 | Yamaguchi et al. |
| 2008/0310904 | A1 | | 12/2008 | Yamaguchi et al. |
| 2009/0016795 | A1 | | 1/2009 | Caveney et al. |
| 2009/0202283 | A1 | | 8/2009 | Kumazaki et al. |
| 2011/0058884 | A1 | | 3/2011 | Kato et al. |

FOREIGN PATENT DOCUMENTS

| | | | |
|---|---|---|---|
| EP | 0629509 | | 6/1993 |
| EP | 0644506 | | 9/1994 |
| EP | 0684143 | | 11/1994 |
| EP | 734878 | | 3/1995 |
| EP | 1199179 | | 10/2000 |
| EP | 1516739 | | 6/2002 |
| EP | 1284196 | A2 | 2/2003 |
| EP | 1700705 | | 3/2005 |
| EP | 1707395 | | 10/2006 |
| EP | 2236304 | A1 | 6/2010 |
| JP | 5-78565 | | 9/1983 |
| JP | 58-139415 | | 9/1983 |
| JP | 60-99692 | | 6/1985 |
| JP | 63-166557 | A | 7/1988 |
| JP | 63-203348 | A | 8/1988 |
| JP | 63-254085 | A | 10/1988 |
| JP | 3-093584 | A | 4/1991 |
| JP | 3-120680 | | 5/1991 |
| JP | 3063155 | | 9/1991 |
| JP | 3-118672 | | 12/1991 |
| JP | 4-37575 | | 2/1992 |
| JP | 5-294051 | | 4/1992 |
| JP | 4-133756 | | 5/1992 |
| JP | 5-16342 | | 1/1993 |
| JP | 5-63067 | | 3/1993 |
| JP | 5-155067 | | 6/1993 |
| JP | 5-54225 | | 7/1993 |
| JP | 5-80765 | U | 11/1993 |
| JP | 6-21953 | U | 3/1994 |
| JP | 6-12053 | | 5/1994 |
| JP | 6-124406 | | 5/1994 |
| JP | 6-152907 | A | 5/1994 |
| JP | 7-314866 | | 5/1994 |
| JP | 6-53560 | U | 7/1994 |
| JP | 6-183117 | | 7/1994 |
| JP | 6-191081 | A | 7/1994 |
| JP | 6-210889 | A | 8/1994 |
| JP | 6-328800 | | 11/1994 |
| JP | 7-1805 | | 1/1995 |
| JP | 7-9743 | | 1/1995 |
| JP | 7-25123 | | 1/1995 |
| JP | 7-47737 | | 2/1995 |
| JP | 7-61009 | | 3/1995 |
| JP | 7-69497 | | 3/1995 |
| JP | 7020725 | | 3/1995 |
| JP | 7-89196 | | 4/1995 |
| JP | 7-101133 | | 4/1995 |
| JP | 7-108702 | A | 4/1995 |
| JP | 7089115 | | 4/1995 |
| JP | 7137327 | | 5/1995 |
| JP | 7-40456 | | 7/1995 |
| JP | 7-237314 | A | 9/1995 |
| JP | 7-251539 | | 10/1995 |
| JP | 7-276695 | A | 10/1995 |
| JP | 7276695 | | 10/1995 |
| JP | H06-74348 | | 10/1995 |
| JP | 7-290803 | | 11/1995 |
| JP | 7-314864 | | 12/1995 |
| JP | 8-25768 | | 1/1996 |
| JP | 9-188049 | | 1/1996 |
| JP | 9-188050 | | 1/1996 |
| JP | 8-39909 | | 2/1996 |
| JP | 8-58211 | A | 3/1996 |
| JP | 8-118738 | | 5/1996 |
| JP | 8-252964 | A | 10/1996 |
| JP | 8-267839 | A | 10/1996 |
| JP | 8-290618 | | 11/1996 |
| JP | H07-314865 | | 12/1996 |
| JP | 2596263 | | 4/1997 |
| JP | 9-134557 | | 5/1997 |
| JP | 9-141986 | A | 6/1997 |
| JP | 10-056604 | A | 2/1998 |
| JP | 10-181063 | A | 7/1998 |
| JP | 11-263055 | | 1/1999 |
| JP | 11-78188 | | 3/1999 |
| JP | 11-105351 | | 4/1999 |
| JP | 11-129563 | | 5/1999 |
| JP | 3543659 | | 9/1999 |
| JP | 2000-25251 | | 1/2000 |
| JP | 2998617 | | 1/2000 |
| JP | 2000-43336 | | 2/2000 |
| JP | 2000-85224 | | 3/2000 |
| JP | 2000-103129 | | 4/2000 |
| JP | 2000-103131 | | 4/2000 |
| JP | 2000-135843 | | 6/2000 |
| JP | 2000-198258 | | 7/2000 |
| JP | 2001-11594 | | 1/2001 |
| JP | 2001-48389 | | 2/2001 |

| | | | |
|---|---|---|---|
| JP | 2001-121797 | A | 5/2001 |
| JP | 2001-310540 | | 11/2001 |
| JP | 2001-319447 | | 11/2001 |
| JP | 2002-42441 | | 2/2002 |
| JP | 3266739 | B2 | 3/2002 |
| JP | 2002-104568 | | 4/2002 |
| JP | 4003068 | | 5/2002 |
| JP | 2002-179300 | | 6/2002 |
| JP | 2002-308481 | | 10/2002 |
| JP | 2002192769 | | 10/2002 |
| JP | 3357128 | | 12/2002 |
| JP | 2003-048337 | A | 2/2003 |
| JP | 2003-251902 | | 9/2003 |
| JP | 2003-285522 | | 10/2003 |
| JP | 3543659 | | 7/2004 |
| JP | 2004-291591 | | 10/2004 |
| JP | 2004-323241 | | 11/2004 |
| JP | 2005-088597 | A | 4/2005 |
| JP | 2005-231203 | | 9/2005 |
| JP | 2005-280008 | | 10/2005 |
| JP | 2005297348 | | 10/2005 |
| JP | 4061507 | | 11/2005 |
| JP | 2002-367333 | | 12/2005 |
| JP | 2006096030 | | 4/2006 |
| JP | 2006-142835 | | 6/2006 |
| JP | 2006-182034 | | 7/2006 |
| JP | 2006-240310 | A | 9/2006 |
| JP | 2006-248059 | | 9/2006 |
| JP | 2006-272895 | | 10/2006 |
| JP | 2006-272977 | | 10/2006 |
| JP | 2006-289991 | | 10/2006 |
| JP | 2007-196654 | A | 8/2007 |
| JP | 2007-296863 | | 11/2007 |
| JP | 2008-80668 | | 4/2008 |
| JP | 2008-509823 | A | 4/2008 |
| JP | 2008083432 | | 4/2008 |
| JP | 2008-229855 | A | 10/2008 |
| JP | 2009-28976 | | 2/2009 |
| JP | 2009-509812 | A | 3/2009 |
| JP | 2009-184832 | A | 8/2009 |
| JP | 2011-110843 | A | 6/2011 |
| JP | 2011-110845 | A | 6/2011 |
| JP | 2011-110848 | A | 6/2011 |
| WO | 00/32401 | | 6/2000 |
| WO | 03/080350 | | 10/2003 |
| WO | 2006/024913 | | 3/2006 |
| WO | 2006/090842 | | 8/2006 |
| WO | 2009/107534 | A1 | 9/2009 |

OTHER PUBLICATIONS

International Preliminary Report on Patentability in PCT/JP2010/055324 on Nov. 15, 2011.
International Preliminary Report on Patentability in PCT/JP2010/055326 on Nov. 15, 2011.
International Preliminary Report on Patentability in PCT/JP2010/050253 on Nov. 15, 2011.
Japanese Office Action in JP 2009-086239 on May 8, 2012.
Japanese Office Action in JP 2009-086222 on Jun. 12, 2012.
International Preliminary Report on Patentability in PCT/JP2010/055310 on Apr. 11, 2012.
Notification of reasons for rejection issued in the related Japanese Application No. 2009-088241, Nov. 15, 2011, JPO, Japan.
International Preliminary Report on Patentability of PCT/JP2009/071812 dated Aug. 14, 2012.
Japanese Office Action of JP 2009-086172 dated Sep. 11, 2012.
Japanese Office Action of JP 2009-088449 dated Sep. 11, 2012.
Japanese Office Action of JP 2010-084500 dated Jul. 3, 2012.
Japanese Office Action of JP 2010-084501 dated Jul. 3, 2012.
Japanese Office Action of JP 2010-084502 dated Jul. 3, 2012.
Japanese Office Action of JP 2010-084500 dated Jul. 13, 2012.
Japanese Office Action in JP 2010-041323 on May 22, 2012.
Japanese Office Action in JP 2010-084499 on Jun. 12, 2012.
Japanese Office Action in JP 2008-331639 on Mar. 27, 2012.
Japanese Office Action in JP 2008-331638 on Mar. 27, 2012.
Japanese Office Action in JP 2009-156405 on Mar. 27, 2012.
Japanese Office Action in JP 2009-156406 on Mar. 27, 2012.
Japanese Office Action in JP 2009-156407 on Mar. 27, 2012.
Japanese Office Action in JP 2009-270221 on Mar. 27, 2012.
European Communication of EP 10711477.9 dated Sep. 6, 2012.
NZ Examination Report of NZ 596044 dated Sep. 28, 2012.
Japanese Office Action of JP 2009-270056 dated Nov. 13, 2012.
Japanese Office Action of JP 2009-297502 dated Nov. 13, 2012.

* cited by examiner

PRINTER

CROSS-REFERENCE TO RELATED APPLICATION

This application claims priority to Japanese Patent Application No. 2009-139528 and 2009-139565, respectively filed Jun. 10, 2009. The disclosure of the foregoing applications is herein incorporated by reference in its entirety.

BACKGROUND

The present disclosure relates to a tape printer that is configured to detachably house a tape cassette therein and that performs printing on a tape included in the tape cassette.

A printer is known in which a type (a tape width, a print mode and so on) of a tape mounted in a tape cassette installed in a cassette housing portion is detected by a plurality of detecting switches. More specifically, a cassette detection portion is provided on a section of the bottom surface of the tape cassette, the detection portion being formed of through-holes in a pattern corresponding to the type of the tape. When the tape cassette is inserted in the cassette housing portion, the plurality of detecting switches, which are constantly urged in an upward direction, are selectively depressed in accordance with the pattern of the through-holes formed in the cassette detection portion. In the tape printer, the type of tape of the tape cassette inserted in the cassette housing portion is detected according to the combination of the depressed and non-depressed switches among the plurality of detecting switches.

SUMMARY

In tape printers provided with mechanical detecting switches that detect pin pressure, a tape cassette inside a cassette housing portion can easily be lifted due to the repulsive force of the detecting switches that protrude in the upward direction. This results in concerns that a proper positional relationship between a printing head and the tape may be lost, a print position on the tape may be displaced, resulting in a deterioration in print quality, or tape feed defects may occur.

In the cassette housing portion, a drive shaft to feed the tape and the ink ribbon etc. housed in the tape cassette, and a head holder to hold the thermal head etc. are installed upright, thus restricting the area in which the detecting switches can be installed. For that reason, when the detecting switches are arranged in the cassette housing portion, restrictions on the design of the printer occur, leading to concerns that the printer may become larger.

Various exemplary embodiments of the general principles herein provide a printer that is capable of appropriate detection of a tape type of a tape cassette that is installed in a cassette housing portion without an increase in device size.

The exemplary embodiments provide a printer that includes a cassette housing portion into which a tape cassette is detachably installed in a vertical direction, the tape cassette having a box-shaped cassette case in which is mounted a tape, and a side surface of the cassette case having an indicator portion that indicates a type of the tape. The printer also includes a feeding device that feeds the tape mounted in the tape cassette that is installed in the cassette housing portion along a feed path; a printing head that performs printing on the tape that is fed by the feeding device; a platen roller that is located facing the printing head and is pressed against the printing head via the tape; a roller holder that rotatably supports the platen roller and that is capable of moving rotationally between a first position and a second position around a shaft, the first position being a position in which the roller holder extends along the side surface of the tape cassette installed in the cassette housing portion and in which the platen roller presses the printing head via the tape, and the second position being a position in which the platen roller is separated from the printing head, the shaft being parallel to a direction of insertion and removal of the tape cassette; a mechanical sensor having a switch terminal that is capable of protruding and retracting; a sensor holder that holds the mechanical sensor between the shaft of the roller holder and the platen roller and that is capable of moving independently of the roller holder between a third position and a fourth position, the third position being a position in which the sensor holder presses the mechanical sensor against the indicator portion of the tape cassette installed in the tape cassette housing portion, and the fourth position being a position in which the sensor holder separates the mechanical sensor from the indicator portion; and a determination device that determines the type of the tape based on protrusion and retraction of the switch terminal of the mechanical sensor.

The exemplary embodiments also provide a printer that includes a tape cassette having a box-shaped cassette case with a top surface, a bottom surface, a front surface and a pair of side surfaces; a tape that is mounted in the cassette case; and an indicator portion that is provided on the front surface and that indicates a type of the tape. The printer also includes: a cassette housing portion into which the tape cassette is detachably installed in a vertical direction; a feeding device that feeds the tape mounted in the tape cassette that is installed in the cassette housing portion along a feed path; a printing head that performs printing on the tape that is fed by the feeding device; a platen roller that is located facing the printing head and is pressed against the printing head via the tape; a roller holder that rotatably supports the platen roller and that is capable of moving rotationally around a shaft, the shaft being parallel to a direction of insertion and removal of the tape cassette; a mechanical sensor having a switch terminal that is capable of protruding and retracting; a sensor holder that holds the mechanical sensor between the shaft of the roller holder and the platen roller and that is capable of moving independently of the roller holder; and a determination device that determines the type of the tape based on protrusion and retraction of the switch terminal of the mechanical sensor. The cassette case has a discharge portion that is provided along the feed path and that discharges the tape that is fed by the feeding device from the cassette case, and an exposure portion that exposes one surface of the tape in a direction opposite to the front surface while the other surface of the tape faces the printing head. The indicator portion is provided in a position adjacent to the exposure portion on the front surface of the tape cassette and includes at least one aperture formed in a pattern corresponding to the type of the tape. The roller holder is capable of moving rotationally between a first position and a second position, the first position being a position in which the roller holder extends along the front surface of the tape cassette installed in the cassette housing portion and in which the platen roller presses the printing head via the tape, and the second position being a position in which the platen roller is separated from the printing head. The sensor holder is capable of moving between a third position and a fourth position, the third position being a position in which the sensor holder presses the mechanical sensor against the indicator portion of the tape cassette installed in the tape cassette housing portion, and the fourth position being a position in which the sensor holder separates the mechanical sensor from the indicator portion.

BRIEF DESCRIPTION OF THE DRAWINGS

Exemplary embodiments of the present disclosure will be described below in detail with reference to the accompanying drawings in which.

DETAILED DESCRIPTION

Figure 1:
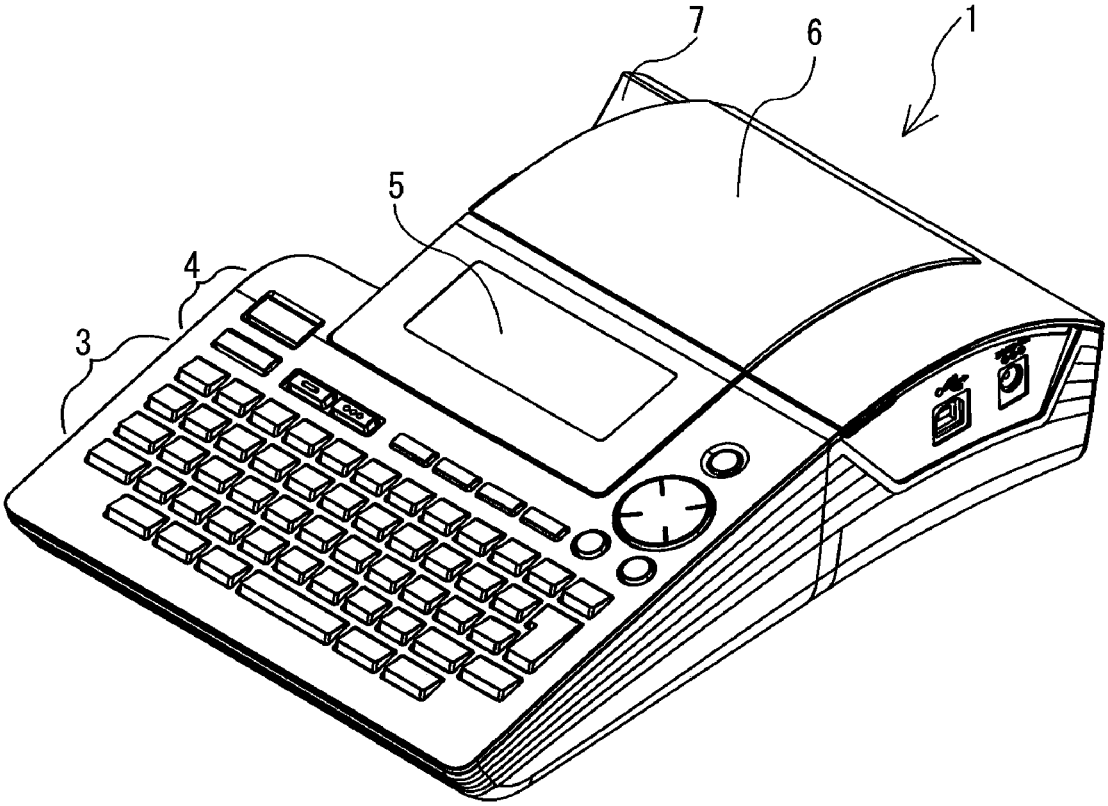
FIG. 1 is a perspective view of a printer 1 when a cassette cover 6 is closed.

Exemplary embodiments of the present disclosure will be explained below with reference to the drawings. The configurations of the apparatus shown in the drawings are merely exemplary and do not intend to limit the present invention.

Figure 2:
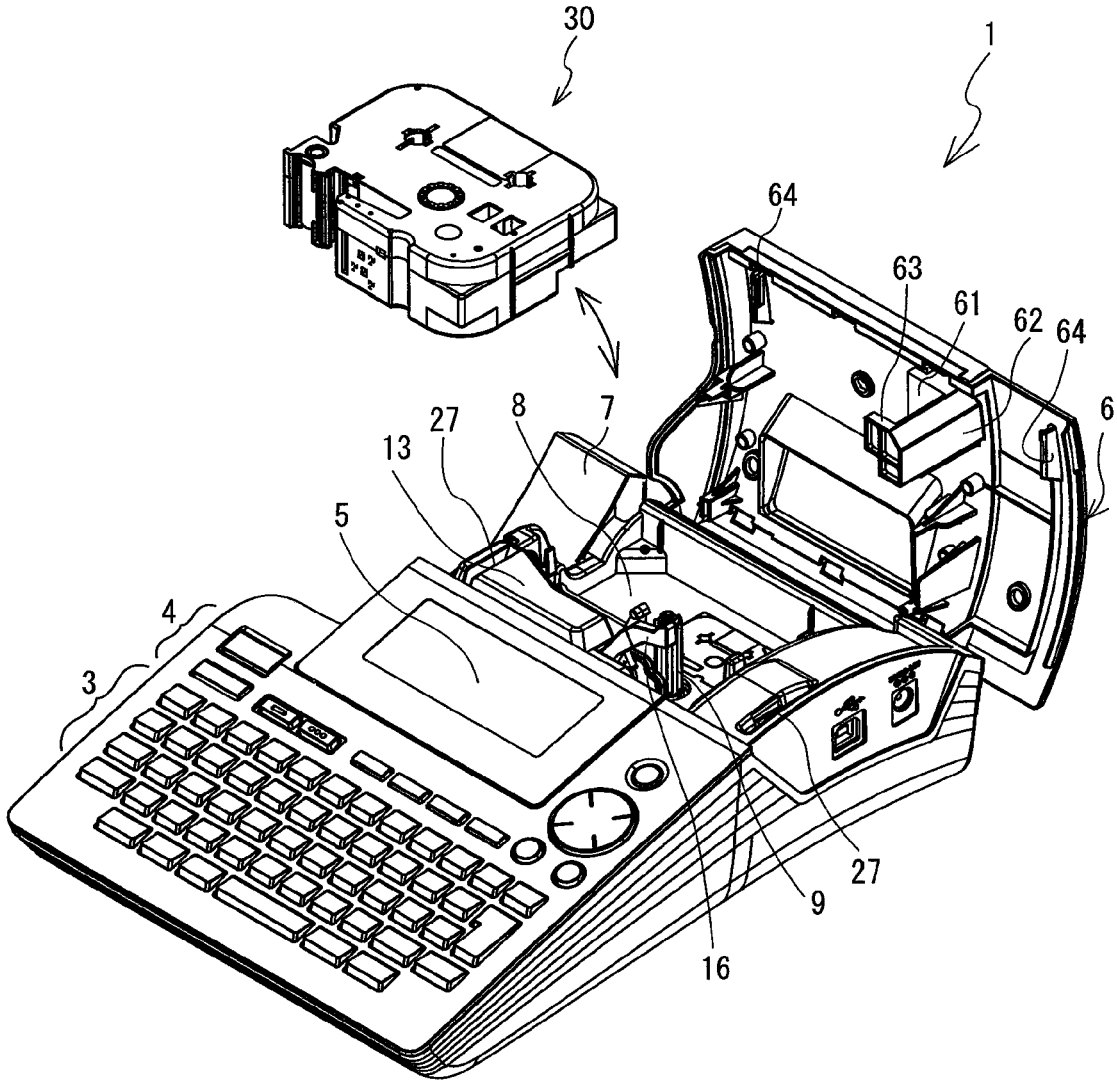
FIG. 2 is a perspective view of the printer 1 and a tape cassette 30 when the cassette cover 6 is closed.

The outline structure of the printer 1 according to the present embodiment will be described with reference to FIG. 1 and FIG. 2. In the explanation of the present embodiment, the upper right side, the lower left side, the lower right side and the upper left side in FIG. 1 and FIG. 2 are respectively defined as the rear side, the front side, the right side, and the left side of the printer 1. In addition, the upper side and the lower side in FIG. 1 and FIG. 2 are respectively defined as the upper side and the lower side of the printer 1.

As shown in FIG. 1, a character (letters, symbols, numerals etc.) keyboard 3 is provided on an upper surface of the printer 1. A power source switch, a print key, and a function key group 4 are provided on the rear side of the keyboard 3 (the upper right side on paper). A liquid crystal display 5 is provided on the rear side of the function key group 4. The liquid crystal display 5 displays input characters and symbols etc. A cover 6 is provided in a rear portion of the upper surface of the printer 1. A tape tray 7 that receives a cut printed tape 50 (refer to FIG. 3) is provided on the left rear corner of the printer 1.

As shown in FIG. 2, cassette housing portion 8 is formed on the rear side of the liquid crystal display 5. The tape cassette 30 can be installed into and removed from the cassette housing portion 8 in a vertical direction. A ribbon take-up shaft 9 is provided standing in the cassette housing portion 8. The ribbon take-up shaft 9 takes up an ink ribbon 60 (refer to FIG. 4) that has been pulled from a ribbon spool 42 (refer to FIG. 4) and used for printing of characters etc. A head holder 74 (refer to FIG. 18) is provided standing to the front left of the ribbon take-up shaft 9. When seen in a front view, the head holder 74 is generally rectangular. A thermal head 10 (refer to FIG. 18) that performs printing of characters etc. on a film tape 59 (refer to FIG. 4) is provided on the front surface of the head holder 74. A tape drive shaft 11 (refer to FIG. 18) that drives the feed of the printed tape 50 is provided standing to the left of the head holder 74.

Figure 8:
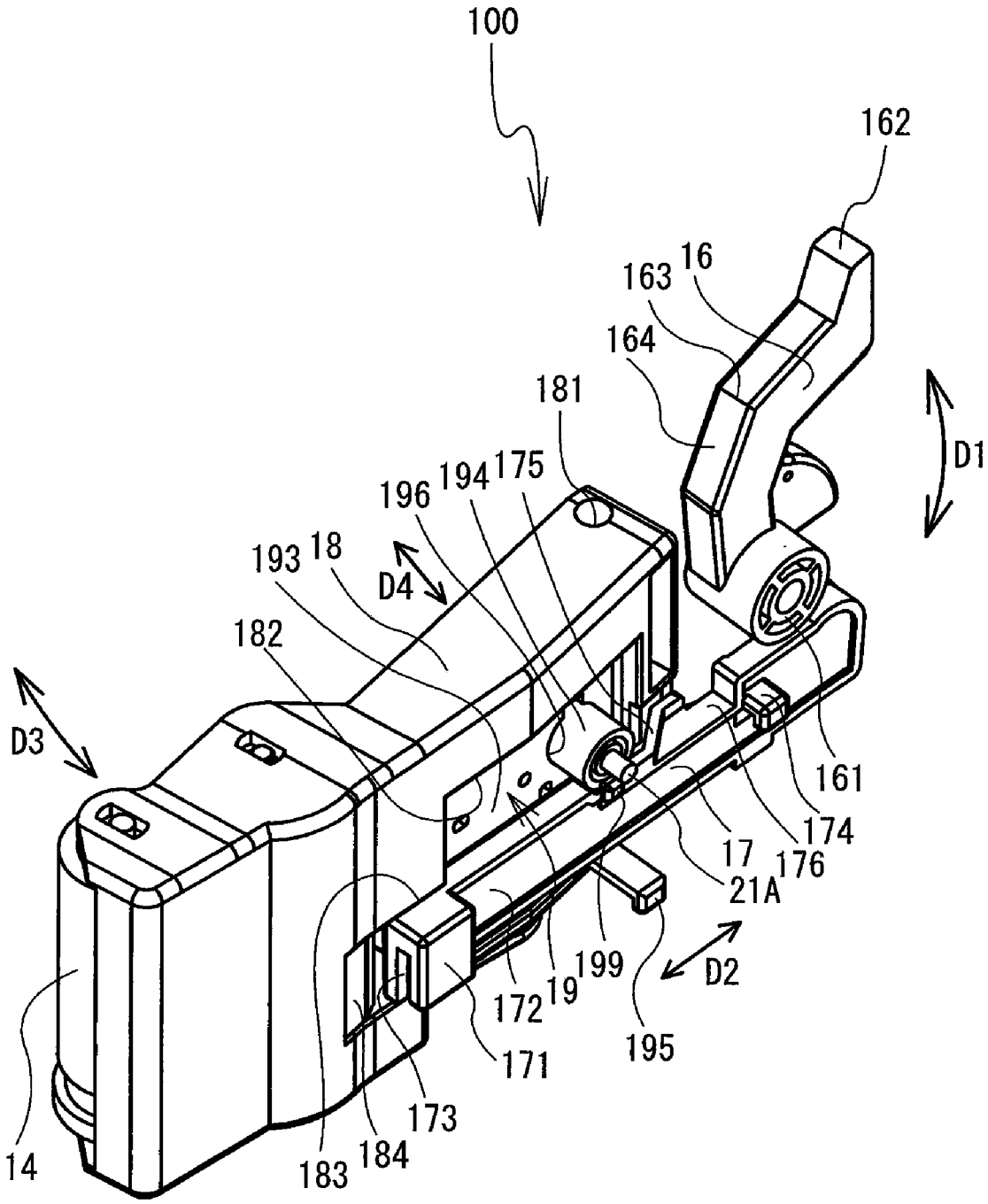
FIG. 8 is a perspective view as seen diagonally from the front of a movable mechanism 100, in which a wall 20 is removed in order to illustrate operation of the movable mechanism 100.

A roller holder 18, a sensor holder 19 and a release rod 17 etc. are arranged on the front side of the cassette housing portion 8 (refer to FIG. 8). The roller holder 18, the sensor holder 19 and the release rod 17 will be described later. The roller holder 18, the sensor holder 19 and the release rod 17 are covered by a board 13. A lever 16 that is coupled to the release rod 17 is provided on the right side of the board 13.

The cover 6 can be freely opened and closed around a fulcrum that runs in the left-and-rightward direction at the rear edge of the cover 6. When the cover 6 is in a closed position, the cassette housing portion 8 is closed such that the tape cassette 30 cannot be installed or removed (refer to FIG. 1), and when the cover 6 is in an open position, the cassette housing portion 8 is opened such that the tape cassette 30 can be freely installed and removed (refer to FIG. 2). A lever depression portion 61, which depresses the lever 16 when the cover 6 is closed, is provided on the underneath front side of the cover 6. A support member 62 is provided on the right side edge of the lever depression portion 61, extending vertically with respect to the underneath surface of the cover 6. A tabular protruding piece 63 protrudes from the lower edge of the support member 62 toward the right side. The protruding piece 63 protrudes in parallel to the lever depression portion 61, and pulls up the lever 16 when the cover 6 is opened.

A pair of latching pieces 64 & 64 are provided on both side edges on the underneath surface of the cover 6. A pair of latching portions 27 & 27 are provided on the outer side of the cassette housing portion 8 in a plan view. When the cover 6 is closed, the latching pieces 64 & 64 fit with the latching portions 27 & 27 and maintain the cover 6 in the closed position.

Next, the structure of the tape cassette 30 according to the present embodiment will be explained with reference to FIG. 3 to FIG. 7. Hereinafter, the tape cassette 30 configured as a general purpose cassette will be explained as an example. the tape cassette 30 may be assembled as the thermal type, the receptor type and the laminated type, by changing, as appropriate, the type of the tape to be mounted in the tape cassette 30 and by changing the presence or absence of the ink ribbon, and so on. In the explanation of the present embodiment, the tape cassette 30 is the laminated type. The upper left side, the lower right side, the upper right side, the lower left side, the upper side and the lower side in FIG. 3 are, respectively, the rear side, the front side, the right side, the left side, the upper side and the lower side of the tape cassette 30.

Figure 3:
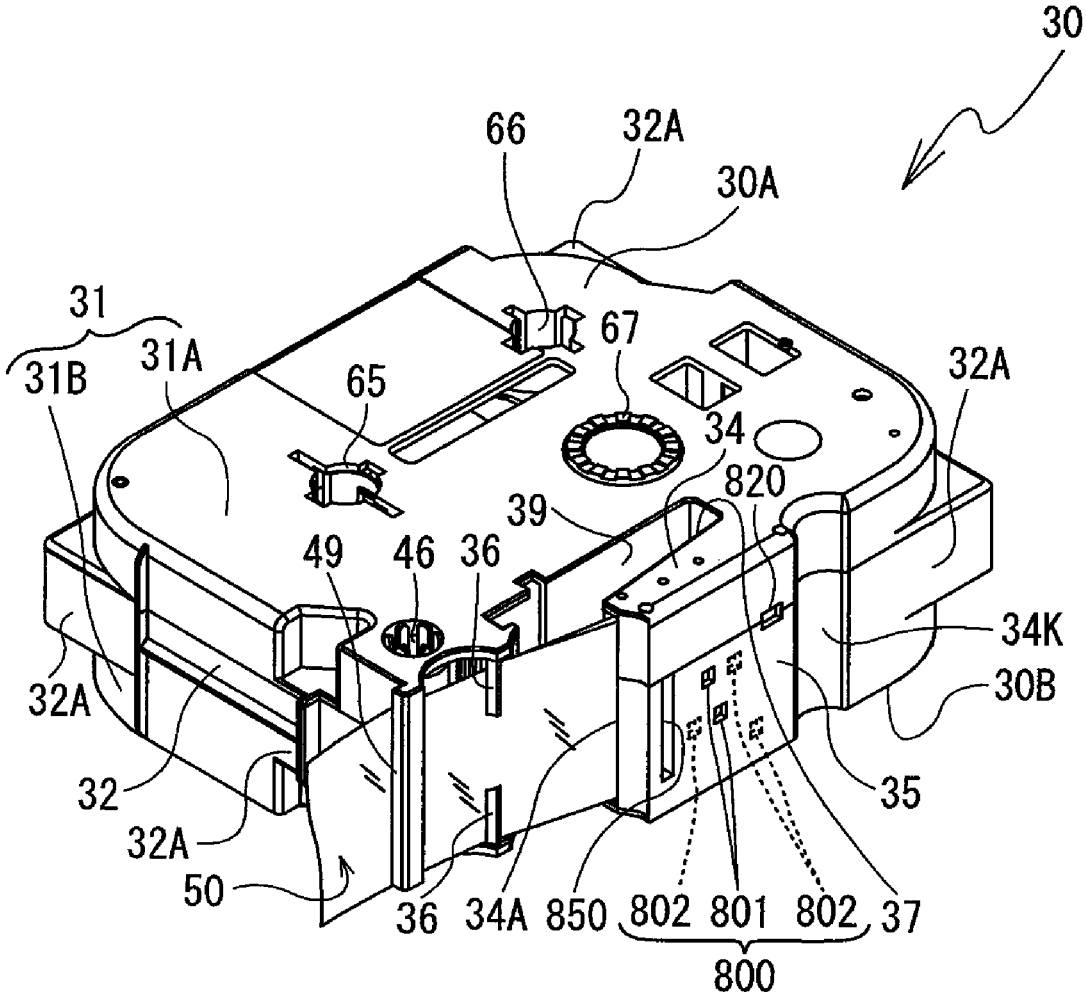
FIG. 3 is a perspective view of the tape cassette 30.

As shown in FIG. 3, the tape cassette 30 includes a cassette case 31 that is overall a generally square shaped (box shaped) housing with rounded corner portions in a plan view. The cassette case 31 is formed of a bottom case 31B that includes a bottom surface 30B of the cassette case 31 and a top case 31A that includes a top surface 30A of the cassette case 31. The top case 31A is fixed to an upper portion of the bottom case 31B. In the explanation of the present embodiment, a distance from the bottom surface 30B to the top surface 30A is referred to as the height of the tape cassette 30 or the cassette case 31.

The cassette case 31 has the corner portions 32A that have the same width (the same length in the vertical direction), regardless of the tape type of the tape cassette 30. The corner portions 32A each protrude in an outward direction to form a right angle when seen in a plan view. However, the lower left corner portion 32A does not form a right angle in the plan view, as the tape discharge portion 49 is provided in the corner. The cassette case 31 includes a portion that is called the common portion 32. The common portion 32 includes the corner portions 32A and encircles all the side surfaces of the cassette case 31 at the same position as the corner portions 32A in the vertical (height) direction of the cassette case 31 and also has the same width as the corner portions 32A.

Figure 5:
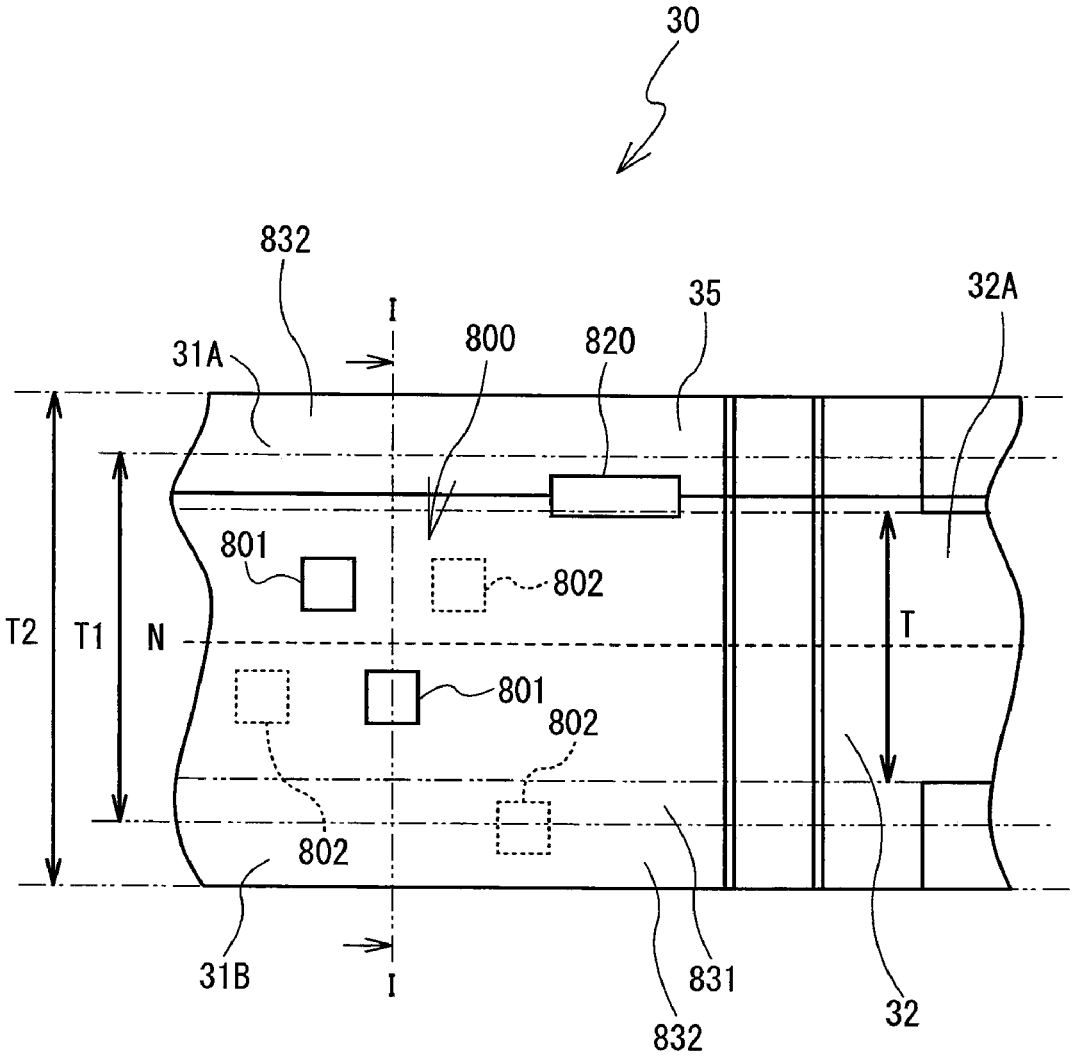
FIG. 5 is an enlarged front view of an arm front surface 35 of the wide-width tape cassette 30.
Figure 7:
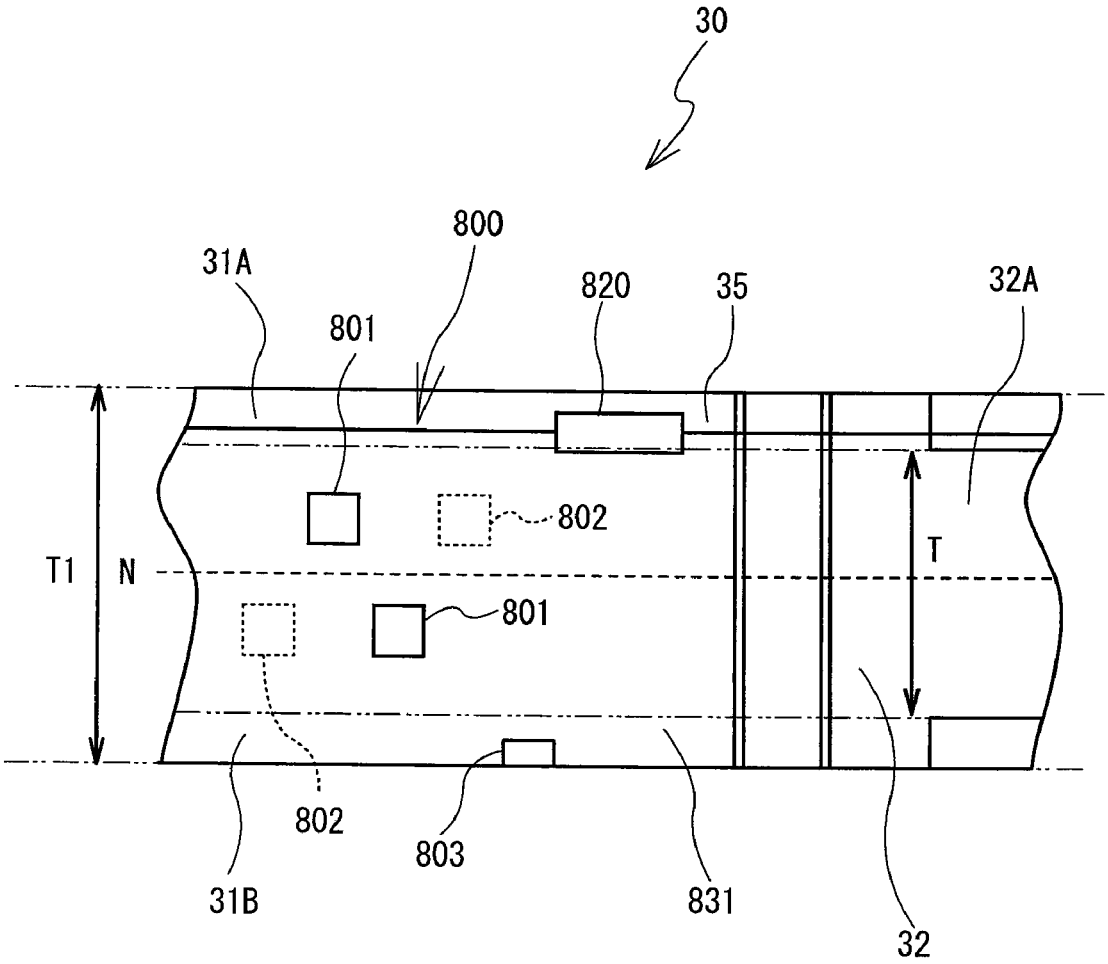
FIG. 7 is an enlarged front view of the arm front surface 35 of the narrow-width tape cassette 30.

As shown in FIG. 5 and FIG. 7, the common portion 32 is a portion that is formed symmetrically in the vertical direction with regard to a central line that runs in the vertical (height) direction of the cassette case 31. Note that the height of the tape cassette 30 differs depending on the width of the film tape 59 or the double-sided adhesive tape 58 housed in the cassette case 31 (namely, the printed tape 50). However, a width T of the common portion 32 (the length in the vertical direction) is set to be the same dimension, regardless of the width of the printed tape 50.

For example, when the width T of the common portion 32 is 12 mm, if the width of the printed tape 50 is larger (18 mm, 24 mm, 36 mm, for example), the height of the cassette case 31 also becomes accordingly larger, but the width T of the common portion 32 remains constant. Note that, when the width of the printed tape 50 is equal to or less than the width T of the common portion 32 (6 mm, 12 mm, for example), the height of the cassette case 31 is the width T of the common portion 32 (12 mm) plus a predetermined width. The height of the cassette case 31 is at its smallest in this case.

As shown in FIG. 3, the top case 31A and the bottom case 31B respectively have support holes 65, 66 and 67 that rotatably support spools, which will be explained later. Only the support holes 65, 66 and 67 formed in the top case 31A are shown in FIG. 3, but the support holes 65, 66 and 67 are also formed in a similar manner in the bottom case 31B.

Figure 4:
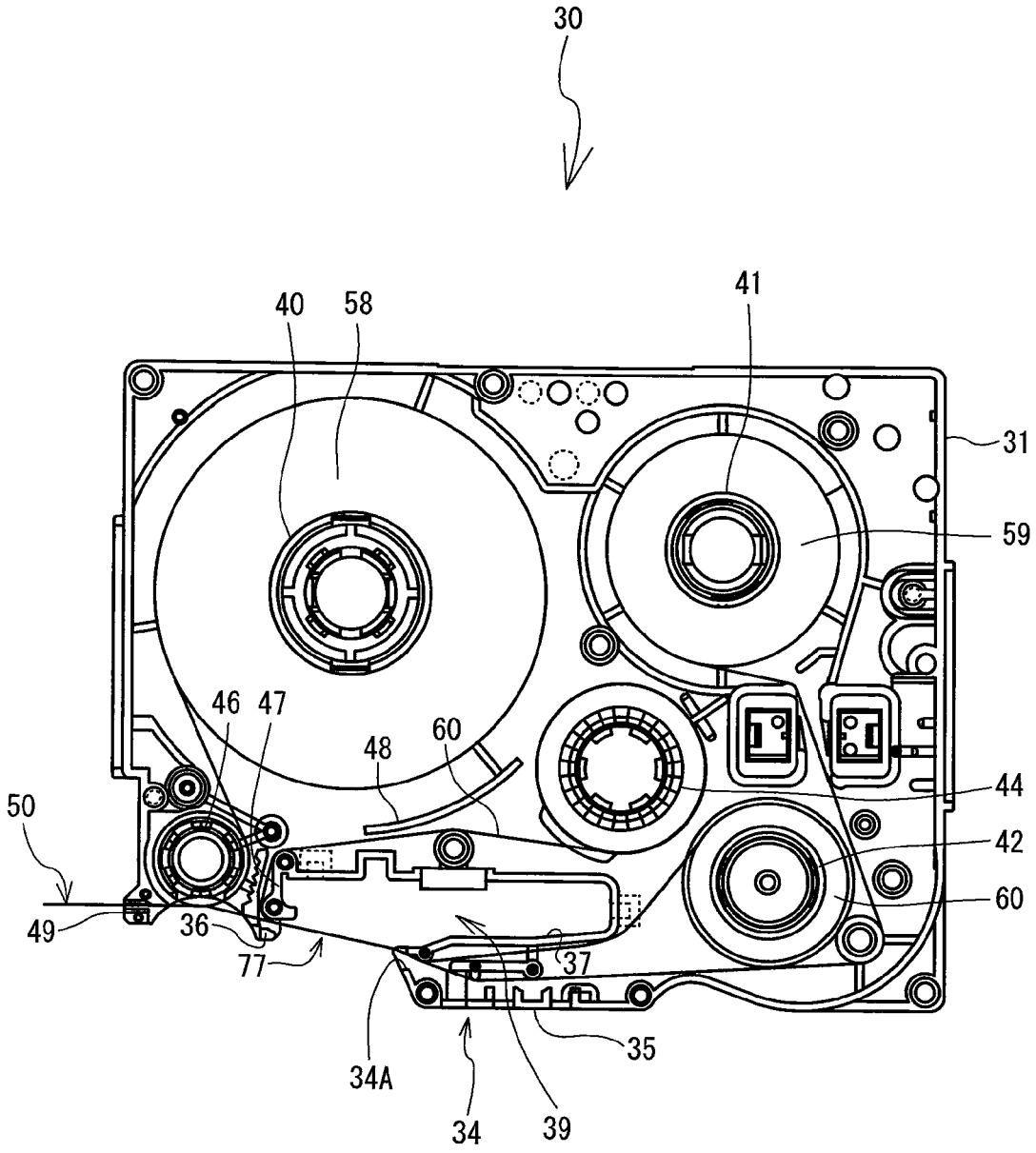
FIG. 4 is a plan view of the tape cassette 30 when a top case 31A is removed.

As shown in FIG. 4, three types of tape roll are housed in the cassette case 31, namely the double-sided adhesive tape 58 wound on a first tape spool 40, the transparent film tape 59 wound on a second tape spool 41 and the ink ribbon 60 wound on the ribbon spool 42. The double-sided adhesive tape 58 is a double-sided adhesive tape with a release paper adhered to one surface, and stuck to the print surface of the film tape 59.

The first tape spool 40, on which the double-sided adhesive tape 58 is wound with its release paper facing outward, is rotatably mounted around the support holes 65 on the left side and to the rear inside the cassette case 31. The second tape spool 41, on which the film tape 59 is wound, is rotatably mounted around the support holes 66 on the right side and to the rear inside the cassette case 31. The ink ribbon 60, which is wound on the ribbon spool 42, is rotatably arranged on the right side and to the front inside the cassette case 31.

Between the first tape spool 40 and the ribbon spool 42 in the cassette case 31, a ribbon take-up spool 44 is mounted around the support holes 67. The ribbon take-up spool 44 pulls out the ink ribbon 60 from the ribbon spool 42 and takes up the ink ribbon 60 that has been used to print characters. A clutch spring (not shown in the figures) is attached to a lower portion of the ribbon take-up spool 44 to prevent loosening of the taken up ink ribbon 60 due to reverse rotation of the ribbon take-up spool 44.

As shown in FIG. 3, a semi-circular groove 34K that has a cross-sectional semi-circular shape in a plan view is provided in the front surface of the cassette case 31, and extends over the height of the cassette case 31 (in other words, extends from the top surface 30A to the bottom surface 30B). The semi-circular groove 34K is a recess provided such that, when the tape cassette 30 is installed in the cassette housing portion 8, there is no interference between a shaft support 181 of the roller holder 18 (refer to FIG. 8) and the cassette case 31. Of the front surface of the cassette case 31, a section that stretches leftwards from the semi-circular groove 34K is referred to as an arm front surface 35. A part that is defined by the arm front surface 35 and an arm rear surface 37 and that extends leftwards from the right portion of the tape cassette 30 is referred to as an arm portion 34. The arm rear surface 37 is separately provided at the rear of the arm front surface 35 and extends over the height of the cassette case 31.

As shown in FIG. 4, the film tape 59 that is pulled from the first tape spool 41 and the ink ribbon 60 that is pulled from the ribbon spool 42 are guided together inside the arm portion 34. An end of the arm front surface 35 bends in a rearward direction. An exit 34A is formed by ends of the arm front surface 35 and the arm rear surface 37. The film tape 59 and the ink ribbon 60 are joined together at the exit 34A and are discharged toward an opening 77 that will be described later.

A space that is surrounded by the arm rear surface 37 and a peripheral wall surface that extends continuously from the arm rear surface 37 is the head insertion portion 39. The head insertion portion 39 has a generally rectangular shape in a plan view and penetrates through the cassette case 31 in the vertical direction. The head insertion portion 39 is connected to the outside at the front surface side of the tape cassette 30, through the opening 77 formed in the front surface of the tape cassette 30. The head holder 74 that supports the thermal head 10 of the printer 1 (refer to FIG. 18) is inserted into the head insertion portion 39. One surface of the film tape 59 that is discharged from the exit 34A is exposed to the front at the opening 77, and the other surface opposes the thermal head 10 positioned to the rear. In the present embodiment, the other surface of the film tape 59 opposes the thermal head 10 across the ink ribbon 60. At the opening 77, printing is performed by the thermal head 10 on the film tape 59 using the ink ribbon 60.

As shown in FIG. 3 and FIG. 4, the tape drive roller 46 is rotatably and axially supported on the feed path for the film tape 59 and the ink ribbon 60 from the exit 34A to the tape discharge portion 49, on the downstream side of the head insertion portion 39. The tape drive roller 46 is driven to rotate by the tape drive shaft 11 (refer to FIG. 18) that is inserted into the tape drive roller 46. The tape drive roller 46 moves in concert with a movable feed roller 14 (refer to FIG. 23) that opposes the tape drive roller 46 and thus pulls the film tape 59 from the second tape spool 41 and pulls the double-sided adhesive tape 58 from the first tape spool 40. The double-sided adhesive tape 58 is then guided to and adhered to the print surface of the film tape 59.

A pair of regulating members 36 that match in the vertical direction are provided on the upstream side of the tape drive roller 46. The regulating members 36 regulate the printed film tape 59 in the vertical direction (in the tape width direction), and guide the printed film tape 59 toward the tape discharge portion 49 on the downstream side of the thermal head 10. Thus, the film tape 59 and the double-sided adhesive tape 58 are bonded together appropriately without making any positional displacement. A guide wall 47 is provided standing in the vicinity of the regulating members 36. The guide wall 47 separates the used ink ribbon 60 that has been fed via the head insertion portion 39 from the film tape 59, and guides the used ink ribbon 60 toward the ribbon take-up spool 44. A separating wall 48 is provided standing between the guide wall 47 and the ribbon take-up spool 44. The separating wall 48 prevents mutual contact between the used ink ribbon 60 that is guided along the guide wall 47 and the double-sided adhesive tape 58 that is wound on and supported by the first tape spool 40.

Figure 11:
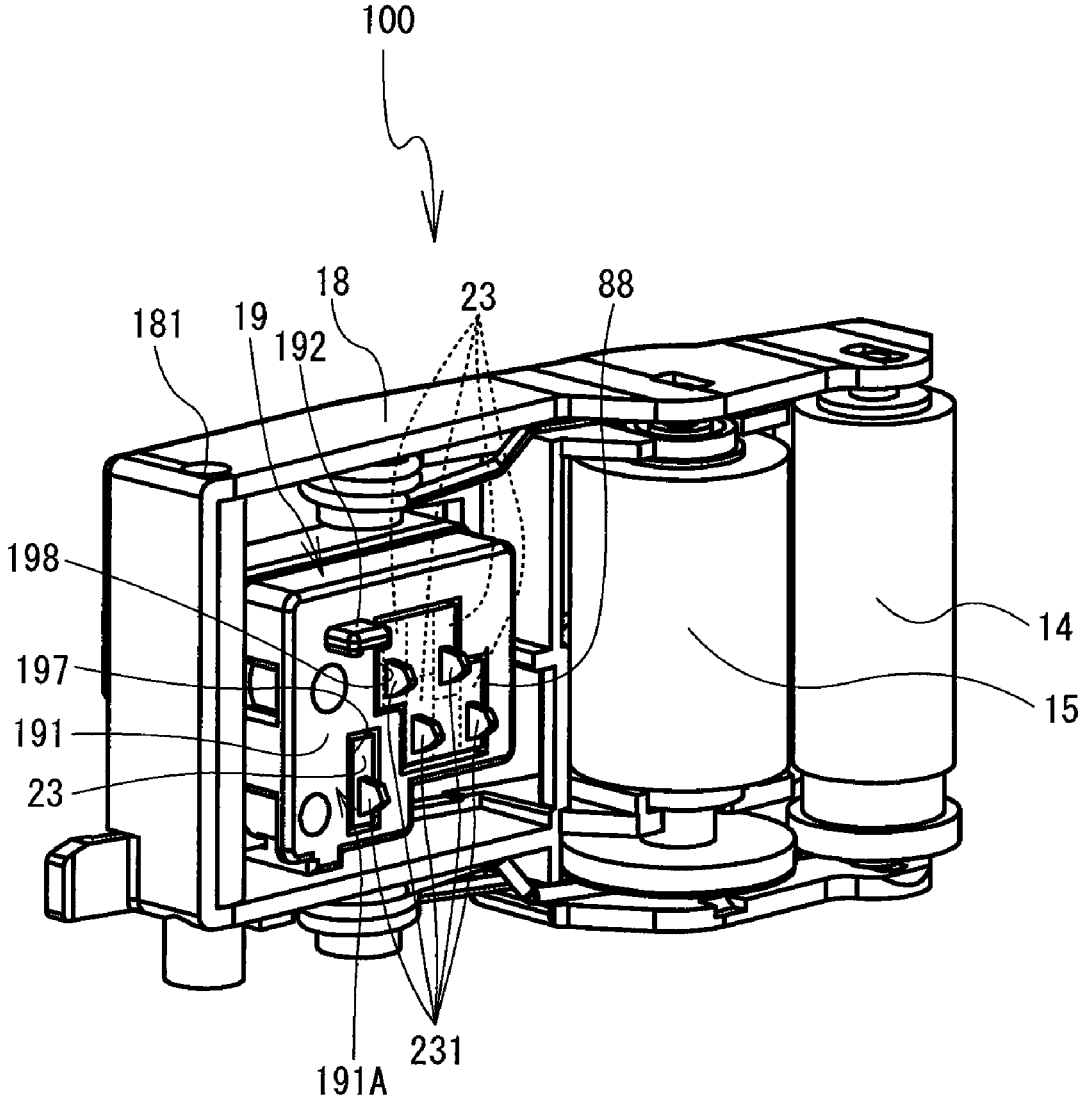
FIG. 11 is a perspective view of a roller holder 18 and a sensor holder 19 as seen diagonally from the rear.
Figure 12:
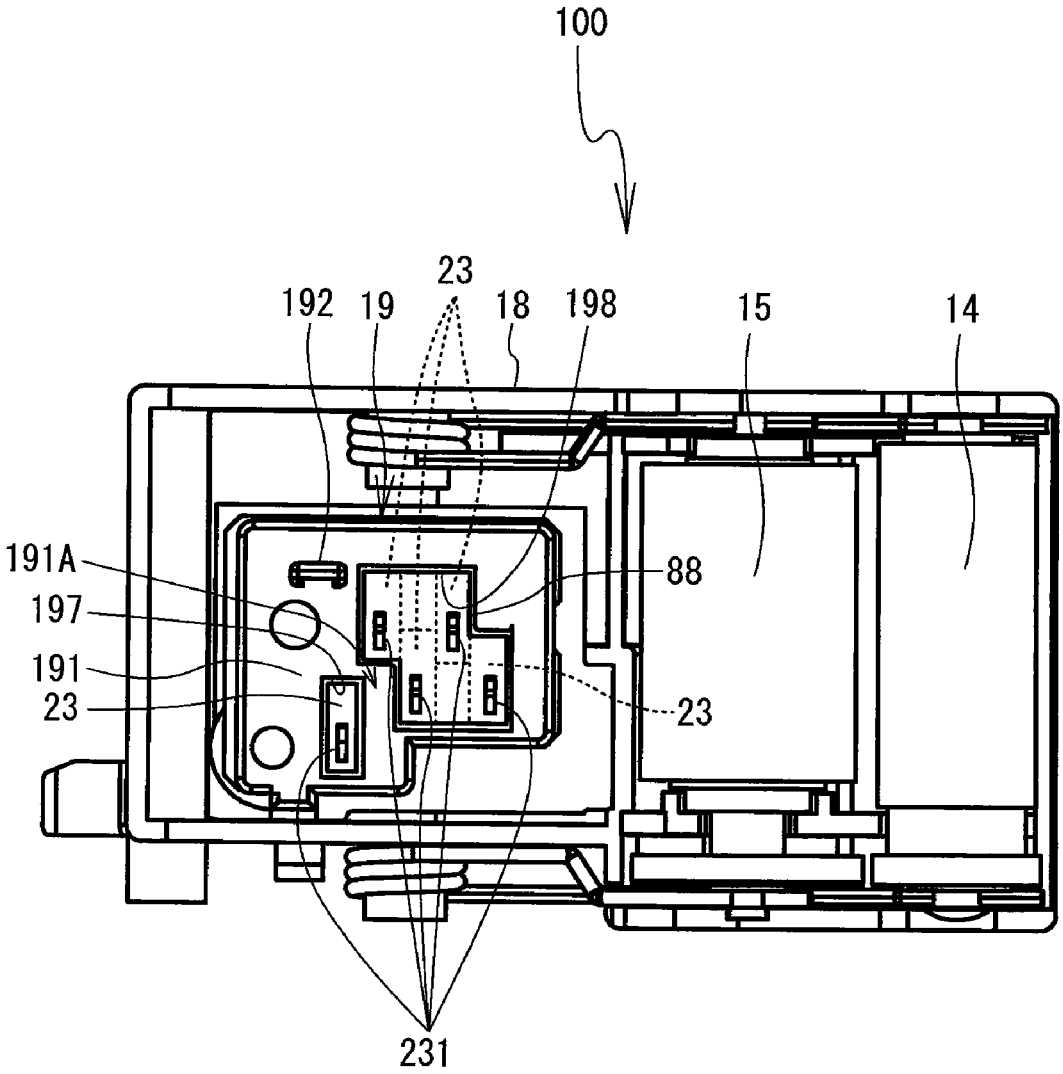
FIG. 12 is a rear view of the roller holder 18 and the sensor holder 19.

As shown in FIG. 3, an arm indicator portion 800 that indicates the tape type of the tape cassette 30 is provided on the arm front surface 35 adjacent to the right side of the opening 77. The arm indicator portion 800 includes a non-pressing portion 801 and a pressing portion 802. The non-pressing portion 801 is a rectangular hole in a front view and allows a switch terminal 231 to be inserted or removed. The pressing portion 802 is a surface portion that comes into contact with the switch terminal 231. The non-pressing portions 801 and the pressing portions 802 are provided in a specific pattern corresponding to the tape type. The non-pressing portion 801 and the pressing portion 802 are positioned such that they respectively correspond to the switch terminals 231 that will be described later (refer to FIG. 11 and FIG. 12). The arm indicator portion 800 according to the present embodiment has the non-pressing portions 801 and the pressing portions 802 in five positions that correspond to the five switch terminals 231. Hereinafter, when the non-pressing portions 801 and the pressing portions 802 are referred to generically, or when neither is particularly specified, they are simply referred to as indicators.

Figure 6:
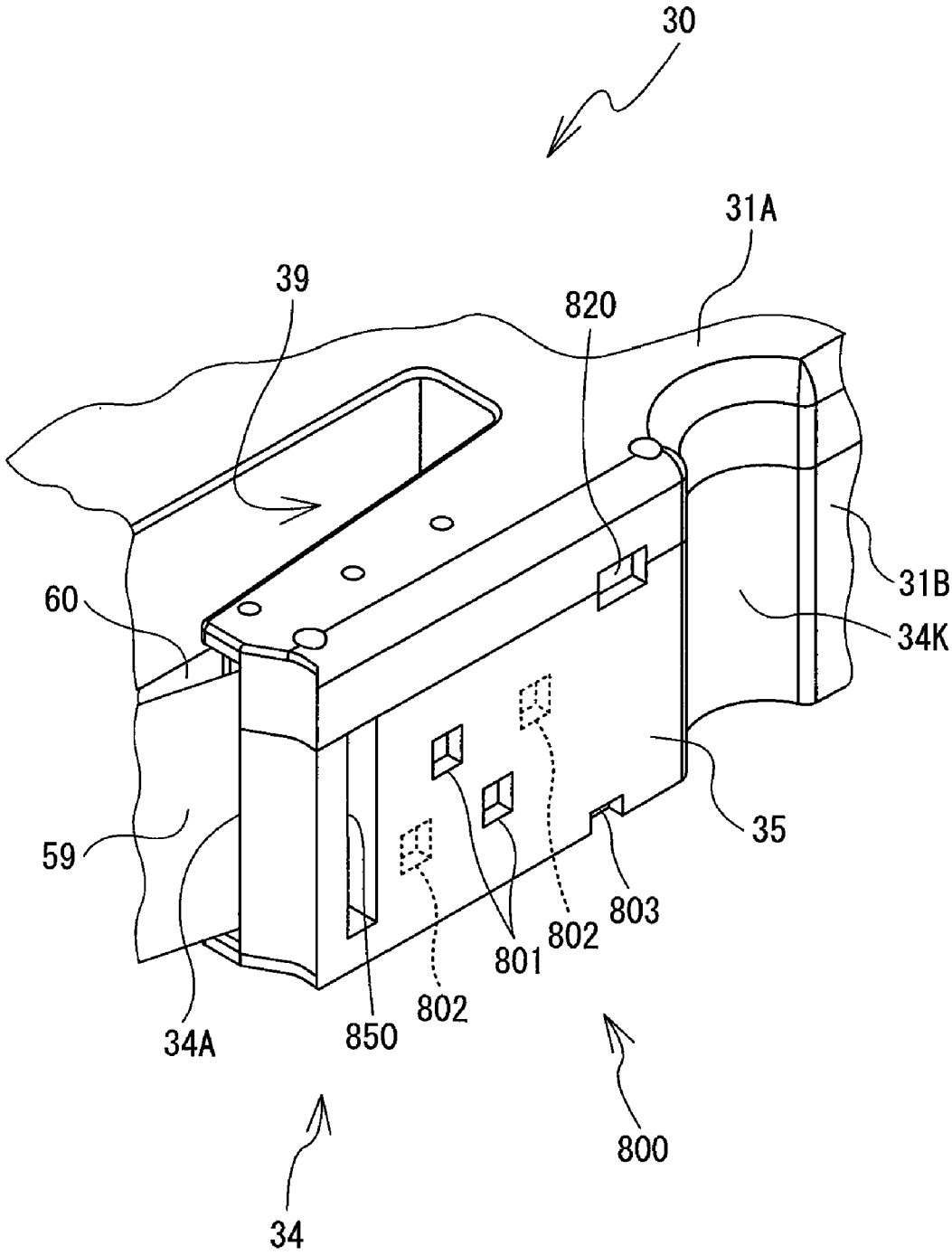
FIG. 6 is an enlarged perspective view of an arm portion 34 of the narrow-width tape cassette 30.

The structure of the arm indicator portion 800 will be explained in detail with reference to FIG. 3 and FIG. 5 to FIG. 7. FIG. 3 and FIG. 5 are figures relating to the wide-width tape cassette 30 in which the tape width of the printed tape 50 is equal to or greater than a prescribed width (18 mm, for example). FIG. 6 and FIG. 7 are figures relating to the narrow-width tape cassette 30 in which the tape width of the printed tape 50 is less than the prescribed width.

As shown in FIG. 3 and FIG. 5 to FIG. 7, for both the wide-width tape cassette 30 and the narrow-width tape cassette 30, at least some of the indicators (the non-pressure portions 801 and the pressure portions 802) of the arm indicator portion 800 are provided within a predetermined height range T1 (hereinafter referred to as the predetermined height T1) of the arm front surface 35. Among the plurality of tape cassettes 30 with different heights, the predetermined height T1 is the height of the tape cassette 30 for which the height of the cassette case 31 is smallest. As described above, the smallest height of the tape cassette 30 is the width T of the common portion 32 plus the predetermined width. An area within the range of the predetermined height T1 of the arm front surface 35 is referred to as a common indicator portion 831.

In the case of the wide-width tape cassette 30, additional indicators may be provided either above or below the common indicator portion 831 within the range of a predetermined height T2 of the arm front surface 35. Areas that are outside the common indicator portion 831 within the predetermined height T2 of the arm front surface 35 are referred to as extension portions 832. In the examples in FIG. 3 and FIG. 5, for example, of the five indicators, four of the indicators are provided in two rows within the common identification portion 831. The remaining indicator is provided extending from the common indicator portion 831 into the extension portion 832 below the common indicator portion 831. In this way, in the wide-width tape cassette 30, by having the arm indicator portion 800 with a larger area that corresponds to the wider arm front surface 35, the number of tape types that can be detected by the printer 1 can be increased.

In the case of the narrow-width tape cassette 30, such that the switch terminal 231 that detects the indicator provided in the extension portion 832 is not pressed, an escape hole 803 is formed in a position corresponding to the switch terminal 231. For example, in the examples shown in FIG. 6 and FIG. 7, the four indicators are provided in two rows within the range of the common indicator portion 831, and the escape hole 803 is formed on the lower edge of the common indicator portion 831.

In this way, when either of the wide-width tape cassette 30 and the narrow-width tape cassette 30 are installed in the cassette housing portion 8, the tape type can be detected by the common mechanical sensor 23. Detection modes for detecting the tape type using the arm indicator portion 800 will be explained separately later.

Whether for the wide-width tape cassette 30 or the narrow-width tape cassette 30, each of the indicators of the arm indicator portion 800 according to the present embodiment are arranged in different positions in the left-and-rightward direction. The five indicators are arranged in a zigzag pattern such that they do not overlap in the vertical direction. Therefore, a line linking each of the identification portions intersects with the vertical direction of the tape cassette 30, which is the direction of installation and removal of the tape cassette 30.

A latching hole 820 is provided on the arm front surface 35 on the upper right side of the arm indicator portion 800. The latching hole 820 is a through hole (refer to FIG. 25) into which a latching piece 192 (refer to FIG. 11 and FIG. 12) is inserted when the sensor holder 19 (to be described later) is moved to an identification position (a position shown in FIG. 24). More specifically, the latching hole 820 extends over a joining portion of the top case 31A and the bottom case 31B and extends in the rightward direction from above the indicator positioned on the rightmost side of the arm indicator portion 800 (the pressing portion 802 in the lowest row in the example in FIG. 5). The latching hole 820 has a generally rectangular shape in a front view, with the long sides running in the left-and-rightward direction.

As shown in FIG. 3 and FIG. 6, a through-hole 850 that is an upright rectangular shape in a front view is provided in the arm front surface 35, to the left side of the arm identification portion 800 of the bottom case 31B. The through-hole 850 is provided as a relief hole for a die used in a molding process of the cassette case 31, and does not have any particular function.

The outline structure of a movable mechanism 100 provided on the printer 1 will be explained with reference to FIG. 8. The movable mechanism 100 according to the present embodiment refers to a series of mechanisms that move in response to external pressure, including the lever 16, the release rod 17, the roller holder 18, the sensor holder 19 and a wall 20 that will be described later (refer to FIG. 9).

In the explanation of the present embodiment, the lower right side, the upper left side, the upper right side, the lower left side, the upper side and the lower side in FIG. 8 correspond, respectively, to the front side, the rear side, the right side, the left side, the upper side and the lower side of the movable mechanism 100. For ease of explanation of operating modes of the movable mechanism 100, FIG. 8 shows the movable mechanism 100 with the wall 20 (refer to FIG. 9) removed. This is also the case for FIG. 16 to FIG. 24, which will be described later.

When a user installs the tape cassette 30 into the cassette housing portion 8 or removes the tape cassette 30 from the cassette housing portion 8, the user opens the cover 6 in the upward direction. When performing printing by the printer 1, the user closes the cover 6 in the downward direction. In accordance with the opening and closing of the cover 6, the lever 16 moves rotationally around a lever shaft 161 in the up-down direction (a rotational movement direction D1 shown in FIG. 8). When the cover 6 is opened in the upward direction, the lever 16 moves rotationally in the upward direction. When the cover 6 is closed in the downward direction, the lever 16 moves rotationally in the downward direction. This will be explained in more detail later.

A lower edge of the lever 16 engages with the release rod 17, the release rod 17 having a tabular shape whose longitudinal direction is the left-and-rightward direction. The release rod 17 moves in the leftward-and-rightward direction in accordance with the circular movement of the lever 16 (a movement direction D2 shown in FIG. 8). The release lever 17 moves in the leftward direction (the downward leftward direction in FIG. 8) when the lever 16 is moved circularly in the downward direction (the downward direction in FIG. 8). The release rod 17 moves in the rightward direction (in the upward rightward direction in FIG. 8) when the lever 16 is moved circularly in the upward direction (the upward direction in FIG. 8). This will be explained in more detail later.

The roller holder 18 is provided on the rear side (the upper left side in FIG. 8) of the release rod 17. The roller holder 18 is provided with a platen roller 15 (refer to FIG. 11) and the movable feed roller 14. The roller holder 18 is pivotably supported around the shaft support 181. The movable feed roller 14 is rotatably supported on the left edge portion of the roller holder 18 such that the roller surface is exposed in the rearward direction. To the right side of the movable feed roller 14, the platen roller 15 is rotatably supported such that the roller surface is exposed in the rearward direction. The movable feed roller 14 and the platen roller 15 are arranged such that they oppose the tape drive roller 46 and the thermal head 10, respectively (refer to FIG. 18).

The roller holder 18 is constantly elastically urged in the forward direction (in the downward rightward direction in FIG. 8) by an urging spring that is not shown in the figures. In accordance with the release rod 17 moving in the left-and-rightward direction (the movement direction D2), the roller holder 18 pivots (a pivot direction D3 shown in FIG. 8) in the back-and-forth direction around the shaft support 181. More specifically, when the release rod 17 moves in the leftward direction, the roller holder 18 resists the urging force of the urging spring and pivots in the rearward direction (the upper leftward direction in FIG. 8). When the release rod 17 moves in the rightward direction, the roller holder 18 pivots in the forward direction (the lower rightward direction in FIG. 8) due to the urging force of the urging spring. This will be explained in more detail later.

A first holder opening 182 is provided between the shaft support 181 and the platen roller 15. The first holder opening 182 has a generally rectangular shape in a front view. The sensor holder 19 is provided on the rear side of the release rod 17 and on the inside of the first holder opening 182. A plurality of mechanical sensors 23 are provided on the sensor holder 19 (refer to FIG. 11). The plurality of mechanical sensors 23 have switch terminals 231 that protrude in the rearward direction (in the upper leftward direction in FIG. 8). The plurality of mechanical sensors 23 are provided in positions that correspond, respectively, to the plurality of indicators provided on the arm indicator portion 800. This will be explained in more detail later.

The sensor holder 19 moves in the back-and-forth direction (a movement direction D4 shown in FIG. 8), in accordance with the movement of the release rod 17 in the left-and-rightward direction (the movement direction D2). More specifically, when the release rod 17 moves in the leftward direction, the sensor holder 19 moves in the rearward direction (the upper leftward direction in FIG. 8). When the release rod 17 moves in the rightward direction, the sensor holder 19 moves in the forward direction (the lower rightward direction in FIG. 8). The sensor holder 19 is not fixed to the roller holder 18 and can therefore move independently from the roller holder 18. This will be explained in more detail later.

According to the above-described structure, with the movable mechanism 100 according to the present embodiment, when the cover 6 is closed in the downward direction, the roller holder 18 pivots in the rearward direction and the sensor holder 19 moves in the rearward direction. When the roller holder 18 pivots in the rearward direction, the platen roller 15 is pressed by the thermal head 10 and the movable feed roller 14 is pressed by the tape drive roller 46. When the sensor holder 19 moves in the rearward direction, the switch terminals 231 of the mechanical sensors 23 are pressed by the arm indicator portion 800. In this way, in the printer 1, it is possible to perform a printing operation using the tape cassette 30 installed in the cassette housing portion 8, and it is also possible to identify the tape type of the tape cassette 30. In the present embodiment, before the switch terminals 231 are pressed by the arm indicator portion 800, the platen roller 15 and the movable feed roller 14 are each first pressed by the thermal head 10 and the tape drive roller 46, respectively. This will be explained in more detail later.

When the cover 6 is opened in the upward direction, the roller holder 18 pivots in the forward direction and the sensor holder 19 moves in the forward direction. When the roller holder 18 pivots in the forward direction, the platen roller 15 is separated from the thermal head 10 and the movable feed roller 14 is separated from the tape drive roller 46. When the sensor holder 19 moves in the forward direction, the switch terminals 231 of the mechanical sensors 23 are separated from the arm indicator portion 800. In this way, in the printer 1, it is possibly to freely install and remove the tape cassette 30 from the cassette housing portion 8. In the present embodiment, after the switch terminals 231 are separated from the arm indicator portion 800, the platen roller 15 and the movable feed roller 14 are each then separated from the thermal head 10 and the tape drive roller 46, respectively. This will be explained in more detail later.

Figure 9:
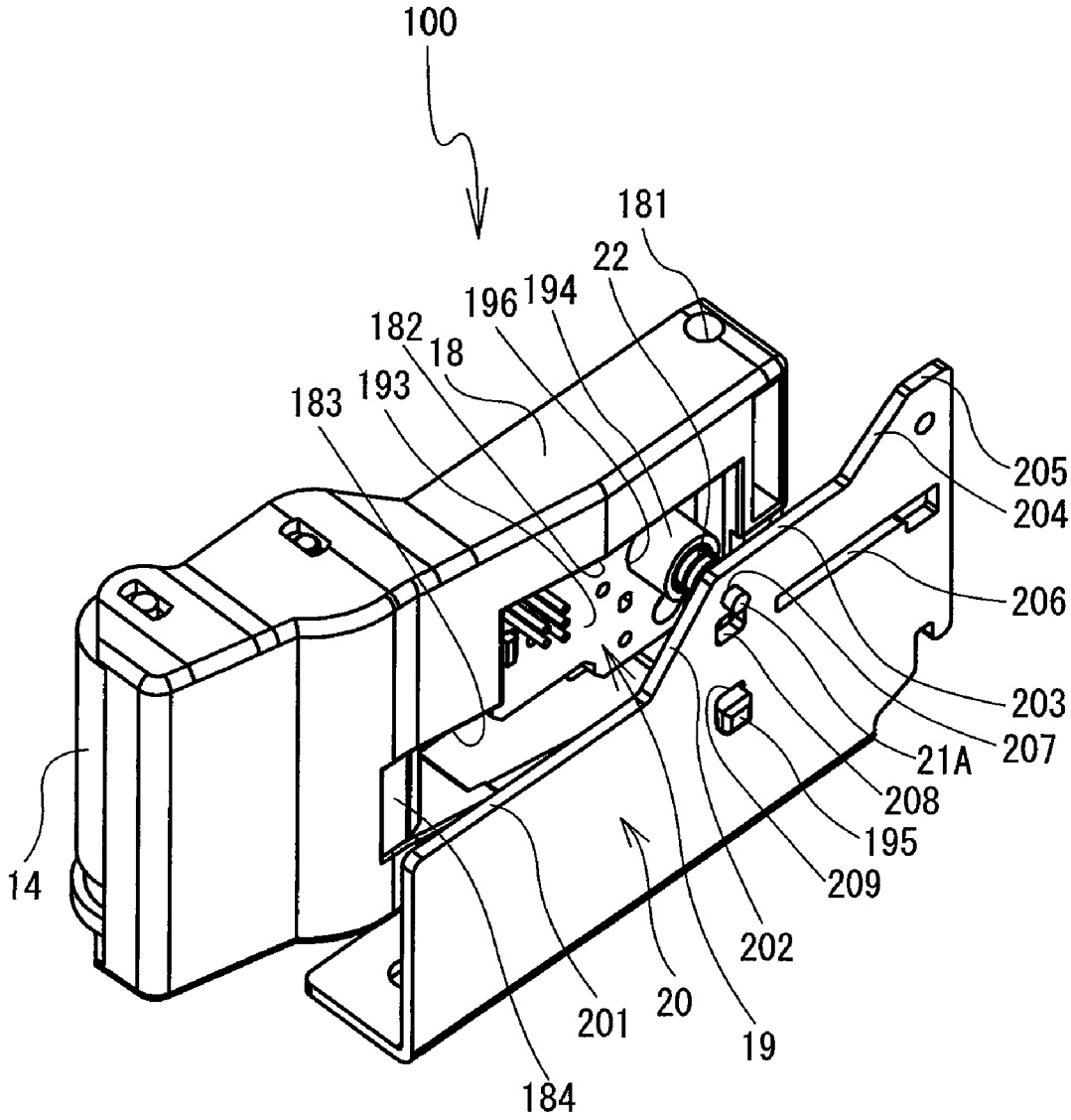
FIG. 9 is a perspective view as seen diagonally from the front of the movable mechanism 100 with a lever 16 and a release rod 17 removed.

The physical structure of each of the members included in the movable mechanism 100 will be explained in more detail with reference to FIG. 8 to FIG. 12. FIG. 9 shows the movable mechanism 100 as seen from the same direction as in FIG. 8. However, in FIG. 9, for ease of explanation of the linked structure of the movable mechanism 100, the movable mechanism 100 is shown in a state in which the roller holder 18 is in a print position (a position shown in FIG. 24), and the sensor holder 19 is in the identification position (the position shown in FIG. 24). Further, the lever 16 and the release rod 17 are removed in FIG. 9.

The physical structure of the lever 16 will be explained with reference to FIG. 8. The lever 16 has a predetermined thickness and width, and is curved such that, in a front view, it extends in the upper rightward direction and describes a generally circular arc. The lever shaft 161 that rotatably supports the lever 16 is provided on a lower edge of the lever 16. A lever protrusion 162 that protrudes in the upward direction is provided on a leading end of the lever 16. A top surface curved portion 163 and a contact surface 164 are provided on the lower left side of the lever protrusion 162. The top surface curved portion 163 is a corner portion that is formed on the outer side of the lever 16 in the direction of the curvature. The contact surface 164 is a surface portion that is provided connected to the lower side of the top surface curved portion 163. The lever protrusion 162, the top surface curved portion 163 and the contact surface 164 are all portions that come into contact with the lever depression portion 61 when the cover 6 is closed (refer to FIG. 2), and they will be explained in more detail later.

Figure 18:
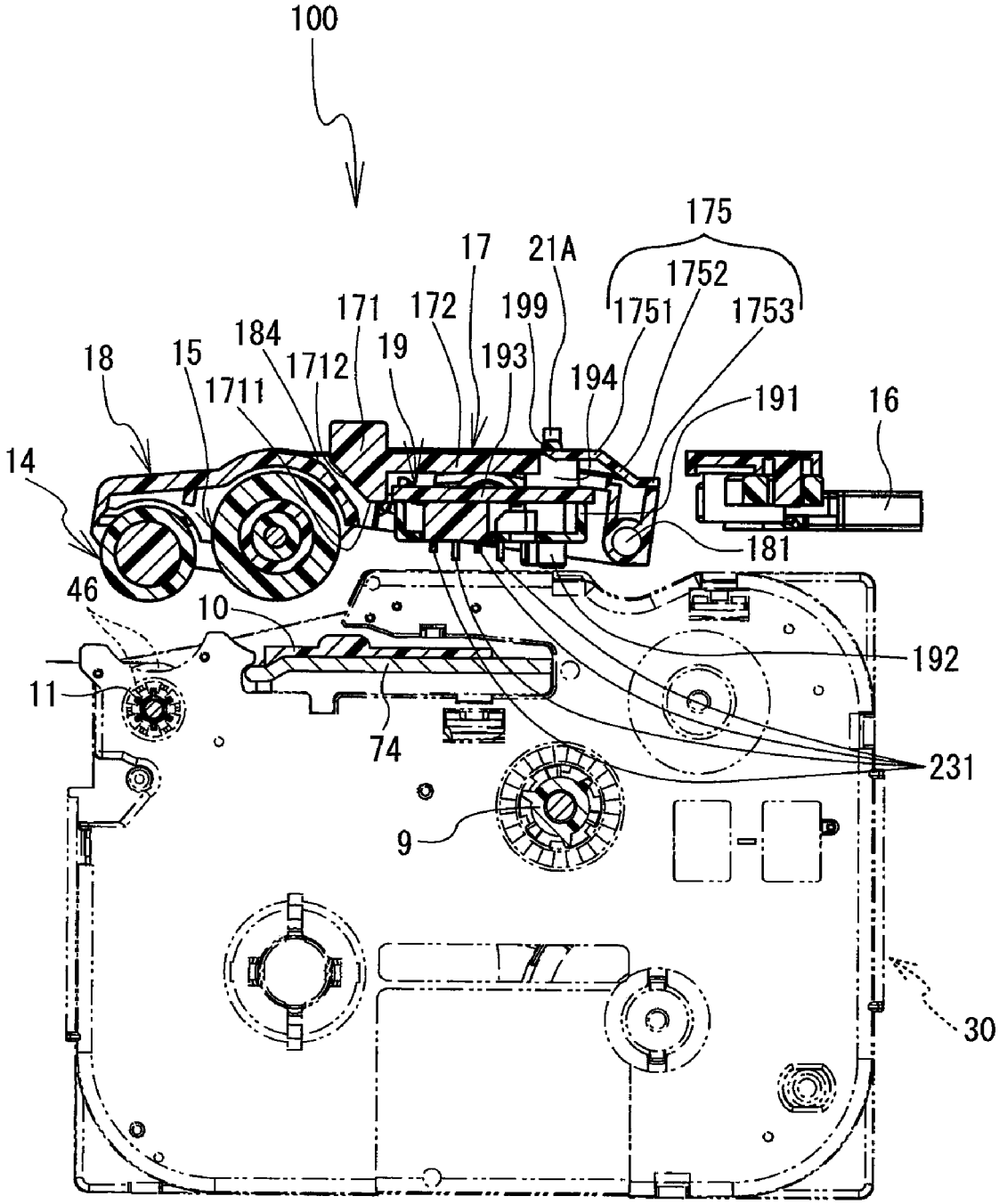
FIG. 18 is a diagram showing a cross-sectional view along a II-II line shown in FIG. 17 as seen in the direction of the arrows, and also showing the tape cassette 30, a tape drive shaft 11 and a thermal head 10.

The physical structure of the release rod 17 will be explained with reference to FIG. 8, FIG. 9 and FIG. 18. FIG. 18 shows a cross section of the movable mechanism 100 when the printer 1 is seen from the bottom surface. FIG. 18 also shows the tape cassette 30 depicted with virtual lines (lines of alternate long and two short dashes). In FIG. 18, for ease of explanation, the wall 20 and a spring member 22 are omitted (this is also the case for FIG. 21 and FIG. 24 which will be described later).

The release rod 17 is engaged with the lower edge of the lever shaft 161 of the lever 16. The release rod 17 is provided with a depression portion 171 and a hollow portion 172. The hollow portion 172 has a predetermined thickness and height, and forms a rectangular cylinder shape whose longitudinal direction extends in the left-and-rightward direction. The depression portion 171 is a head portion that is formed on the left end of the hollow portion 172.

The depression portion 171 causes the roller holder 18 to pivot in the back-and-forth direction (the up-and-down direction in FIG. 18). As the depression portion 171 has a shape that protrudes in the back-and-forth direction from the hollow portion 172 in a plan view, the length of the depression portion 171 in the back-and-forth direction (namely, the thickness) is larger than that of the hollow portion 172. An inclined surface is formed extending across a rear surface of the depression portion 171 from the left surface, such that the depression portion 171 tapers in the left-and-rightward direction in a plan view, rearward from a position of the hollow portion 172 in the back-and-forth direction (the downward direction in FIG. 18). A rear surface portion that is formed parallel to the left-and-rightward direction of the depression portion 171 is a rear surface 1711. With respect to the depression portion 171, an inclined surface that extends in the forward leftward direction from the rear surface 1711 is an inclined surface 1712.

A concavity 176 is provided in the top surface of the hollow portion 172. The concavity 176 is provided within a predetermined range that extends in the rightward direction from a generally central position in the left-and-rightward direction of the hollow portion 172. The concavity 176 is formed as an indentation whose height position is slightly lower than the top surface. A rod guide portion 175 that guides the sensor holder 19 in the back-and-forth direction is formed on the top surface of the concavity 176. The rod guide portion 175 has a first rod guide portion 1751, a rod guide inclined portion 1752 and a second rod guide portion 1753.

The first rod guide portion 1751 is a wall that is provided standing along the front edge of the concavity 176. The first rod guide portion 1751 extends from the left end of the concavity 176 to a position slightly to the left side of the center of the concavity 176. The second rod guide portion 1753 is a wall that is provided standing along the rear edge of the concavity 176. The second rod guide portion 1753 extends in the rightward direction from a position slightly to the right side of the center of the concavity 176. The rod guide inclined portion 1752 is a wall that is provided standing from the concavity 176 such that it obliquely links the right end of the first rod guide portion 1751 and the left end of the second rod guide portion 1753 in a plan view. The first rod guide portion 1751, the rod guide inclined portion 1752 and the second rod guide portion 1753 each have substantially the same thickness and height respectively. The appearance of the rod guide portion 175 as a whole has a rail shape.

A first guide portion 174 is provided on the front surface of the hollow portion 172, on the lower right side when seen from the right end of the concavity 176. The first guide portion 174 is a tab that protrudes in the forward direction from the front surface of the hollow portion 172. Further, the leading end of the first guide portion 174 is bent in the downward direction. A second guide portion 173 is provided on the depression portion 171. The second guide portion 173 extends over the left surface and the right surface of the depression portion 171. The second guide portion 173 is a groove-shaped concavity from the bottom surface in the upward direction. The second guide portion 173 is provided to the front side of position of the hollow portion 172. The first guide portion 174 and the second guide portion 173 guide the movement of the release rod 17 in the left-and-rightward direction.

Figure 10:
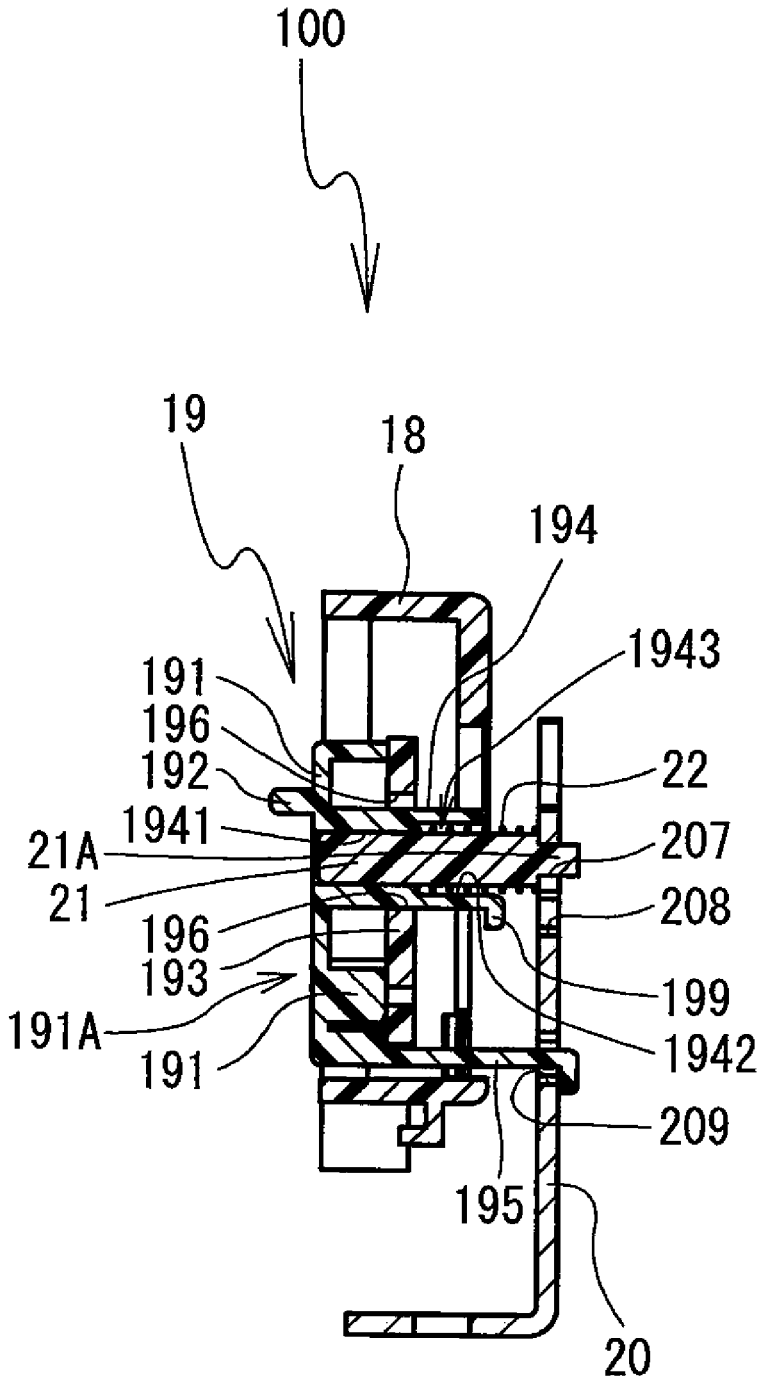
FIG. 10 is a longitudinal section view of the movable mechanism 100.

The physical structure of the wall 20 will be explained with reference to FIG. 9 and FIG. 10. The wall 20 is a tabular member that is long in the left-and-rightward direction, and is provided standing to the front (the lower right side in FIG. 9) of the release rod 17 in the printer 1. Around the top end of the wall 20, the wall 20 has a first upper surface portion 201, a second upper surface portion 202, a third upper surface portion 203, a fourth upper surface portion 204 and a fifth upper surface portion 205. The first upper surface portion 201 to the fifth upper surface portion 205 are provided from the left side to the right side of the wall 20 in the order described above (from the lower left side to the upper right side in FIG. 9), and form a step-shaped line.

The first upper surface portion 201 is formed in the left-and-rightward direction of the wall 20 extending from the left end of the wall 20 to a position slightly to the left of the center of the wall 20, and is a peripheral portion that is formed parallel to the left-and-rightward direction of the printer 1. The third upper surface portion 203 is formed extending from a position slightly to the right of the center of the wall 20 to a position slightly to the left of the right end of the wall 20 and is a peripheral portion that is formed parallel to the left-and-rightward direction of the printer 1 and above the first upper surface portion 201. The fifth upper surface portion 205 is formed in the left-and-rightward direction of the wall 20 on the right end edge of the wall 20, and is a peripheral portion that is formed parallel to the left-and-rightward direction of the printer 1 and above the third upper surface portion 203. The second upper surface portion 202 is a peripheral portion that obliquely links the first upper surface portion 201 and the third upper surface portion 203 that are at differing height positions. The fourth upper surface portion 204 is a peripheral portion that obliquely links the third upper surface portion 203 and the fifth upper surface portion 205 that are at differing height positions.

A long hole 206 is formed to the lower side of the third upper surface portion 203, the fourth upper surface portion 204 and the fifth upper surface portion 205. The Long hole 206 is a groove-shaped penetrating hole which extends in the left-and-rightward direction. A round hole 207, which is a hole that has a circular shape in a front view, is provided to the lower left side of the third upper surface portion 203. A first square hole 208, which has a horizontally long rectangular shape in a front view, is provided to the lower side of the round hole 207. A second square hole 209, which has a horizontally long rectangular shape in a front view, is provided at a position lower than the first square hole 208.

The first guide portion 174 engages slidingly with the long hole 206. The second guide portion 173 engages slidingly with the first upper surface portion 201. The first guide portion 174 is guided along the long hole 206, and the second guide portion 173 is guided along the first upper surface portion 201, thus moving the release rod 17 in the left-and-rightward direction.

The physical structure of the roller holder 18 will be explained with reference to FIG. 8, FIG. 9, FIG. 11, FIG. 12 and FIG. 18. As described above, the roller holder 18 rotatably supports the movable feed roller 14 and the platen roller 15 and is provided to the rear side of the release rod 17. The first holder opening 182 is an opening that extends from the right side edge of the roller holder 18 to a position at which the platen roller 15 is supported in the left-and-right direction. A second holder opening 183 is formed continuously with a left side of opening edges of the first holder opening 182. The second holder opening 183 is an opening that is smaller than the first holder opening 182 and has a generally rectangular shape in a front view. The first holder opening 182 and the second holder opening 183 are joined to form a single opening. A holder side reception portion 184 is provided to the rear of the second holder opening 183. The holder side reception portion 184 extends from the front surface of the platen roller 15 toward the rear right side (the lower rightward direction in FIG. 18) and has a curved surface that follows the roller surface of the platen roller 15.

The release rod 17 is provided such that the hollow portion 172 extends along the left-and-rightward direction of the first holder opening 182 and the depression portion 171 is inserted into the second holder opening 183 from the right side. When the depression portion 171 is separated from the holder side reception portion 184, the holder side reception portion 184 is not pressed by the depression portion 171.

As described above, the roller holder 18 that pivots around the shaft support 181 is constantly elastically urged in the forward direction. When the holder side reception portion 184 is not pressed, the roller holder 18 is maintained in a stand-by position (a position shown in FIG. 18). When the release rod 17 moves to the left side, the depression portion 171 comes into contact with and presses the holder side reception portion 184 inside the second holder opening 183. In this case, the roller holder 18 moves from the stand-by position in the rearward direction (the downward direction in FIG. 18), and this will be explained in more detail later.

The physical structure of the sensor holder 19 will be explained with reference to FIG. 8 to FIG. 12. The sensor holder 19 is provided inside the first holder opening 182 on the rear side of the release rod 17 (the upper left side in FIG. 8). The sensor holder 19 includes a box-shaped unit main body 191, the mechanical sensors 23, the latching piece 192, an electrical board 193, a cylindrical portion 194, the spring member 22 and a rotation prevention member 195.

A first protective portion opening 197 and a second protective portion opening 198, which are openings in two locations, are provided on the unit main body 191, on the side of a surface that opposes the tape cassette 30 installed in the cassette housing portion 8 (hereinafter referred to as a cassette-facing surface 191A). The first protective portion opening 197 is formed as a vertically long generally rectangular shape in a rear view. The second protective portion opening 198 is formed as a rectangular shape on the upper left side of the first protective portion opening 197 (the upper right side in FIG. 12). An opening area of the second protective portion opening 198 is larger than that of the first protective portion opening 197. One of the mechanical sensors 23 is slotted into the first protective portion opening 197. A sensor storage body 88, which holds four of the mechanical sensors 23 together, is inserted into the second protective portion opening 198. The mechanical sensors 23 that are slotted into each of the first protective portion opening 197 and the second protective portion opening 198 are electrically connected to the electrical board 193 that is provided on the unit main body 191.

The electrical board 193 is provided on the front side of the unit main body 191. The front surface of the electrical board 193 is exposed in the forward direction from the first holder opening 182. Although not shown in the figures, an electrical wiring assembly is connected to the front surface of the electrical board 193. The electrical board 193 is electrically connected to a control circuit 400 provided inside the printer 1 (refer to FIG. 15) via the electrical wiring assembly. On and off signals of the mechanical sensors 23 are transferred to a CPU 401 (refer to FIG. 15) via the electrical wiring assembly connected to the electrical board 193.

Each of the mechanical sensors 23 includes the switch terminal 231. The switch terminals 231 protrude in the rearward direction from the cassette-facing surface 191A. In other words, each of the switch terminals 231 protrude such that they oppose the arm front surface 35 (refer to FIG. 3) of the tape cassette 30 installed in the cassette housing portion 8. The switch terminals 231 are provided in positions corresponding to the indicators of the arm indicator portion 800 (the non-pressing portions 801 and the pressing portions 802), respectively (refer to FIG. 5). In the present embodiment, the five switch terminals 231 are arranged in a zigzag pattern. The position of each of the switch terminals 231 is respectively different in the left-and-rightward direction. As a consequence, none of the switch terminals 231 overlap in the vertical direction. A line linking each of the switch terminals 231 intersects with the vertical direction of the printer 1, which is the direction of insertion and removal of the tape cassette 30. The latching piece 192 is provided on an upper right portion of the cassette-facing surface 191A (an upper left portion in FIG. 12). The latching piece 192 is a tabular protrusion whose longitudinal direction is the left-and-rightward direction. A protrusion length of the latching piece 192 is greater than that of the switch terminals 231 in the rearward direction, which will be explained in more detail later.

An electrical board hole 196 is provided in the electrical board 193. The electrical board hole 196 is a circular hole in a front view. The unit main body 191 includes the cylindrical portion 194, which is a cylindrical shape that extends in the forward direction (in the rightward direction in FIG. 10). The cylindrical portion 194 protrudes in the forward direction through the electrical board hole 196 provided in the electrical board 193. The cylindrical portion 194 has a shaft hole that extends in the back-and-forth direction and a small diameter columnar member 21 is inserted into the shaft hole. The shaft hole of the cylindrical portion 194 includes a first shaft hole 1941 and a second shaft hole 1942 that communicate to form a same shaft. The first shaft hole 1941 extends in the forward direction from the cassette-facing surface 191A to a position close to the center of the cylindrical portion 194. The second shaft hole 1942 extends from the first shaft hole 1941 to the front end of the cylindrical portion 194. The second shaft hole 1942 has a larger aperture diameter than the first shaft hole 1941. The columnar member 21 that is inserted into the shaft hole of the cylindrical portion 194 can be slid in the back-and-forth direction along the first shaft hole 1941, which has generally the same diameter as the columnar member 21. A small diameter insertion pin 21A is provided on the leading end of the columnar member 21 on the front side.

The aperture diameter of the second shaft hole 1942 is larger than the diameter of the columnar member 21. For that reason, a spring housing portion 1943 is formed between the columnar member 21 and the cylindrical portion 194. The spring housing portion 1943 is a groove that has a ring shape in a front view. The spring member 22, which has a greater total length than a shaft length of the second shaft hole 1942, is housed in the spring housing portion 1943, and the columnar member 21 is inserted into a winding center of the spring member 22. Inside the spring housing portion 1943, a rear end of the spring member 22 is in contact with a step section that is formed by the differences in diameter of the first shaft hole 1941 and the second shaft hole 1942. In a state in which the spring member 22 is wound on the columnar member 21, the insertion pin 21A is inserted into the round hole 207 and the front end of the spring member 22 is in contact with the wall 20. In this way, the spring member 22 urges the sensor holder 19 in the rearward direction (in the leftward direction in FIG. 10) due to elastic force.

A holder guide portion 199 is provided on a lower portion of the aperture edge at the front of the cylindrical portion 194. The holder guide portion 199 extends in the forward direction. A leading end of the holder guide portion 199 is bent in the downward direction, and this end is engaged with the rod guide portion 175 of the release rod 17. Movement of the sensor holder 19 that is urged in the rearward direction by the spring member 22 is regulated in the rearward direction by the engagement of the holder guide portion 199 and the rod guide portion 175. In accordance with the left-and-rightward direction movement of the release rod 17, the sensor holder 19 moves in the back-and-forth direction while being guided by the rod guide portion 175, and this will be explained in more detail later.

The rotation prevention member 195 is provided on the lower edge of the unit main body 191 and below the sensor holder 19. The rotation prevention member 195 extends in the forward direction. The rotation prevention member 195 penetrates the second square hole 209 of the wall 20, while the leading end of the rotation prevention member 195 that is bent in the downward direction is engaged with the front surface of the wall 20. The sensor holder 19 is fixed to the wall 20 at two points aligned in the vertical direction, namely by the insertion pin 21A and the rotation prevention member 195, and rotational movement of the sensor holder 19 around the columnar member 21 is thus regulated.

The mechanical sensor 23 will be explained in detail with reference to FIG. 13 and FIG. 14. In FIG. 14, of the five mechanical sensors 23, a movement mode of the mechanical sensor 23 in the uppermost left position (the upper right in FIG. 12) is schematically depicted.

Figure 13:
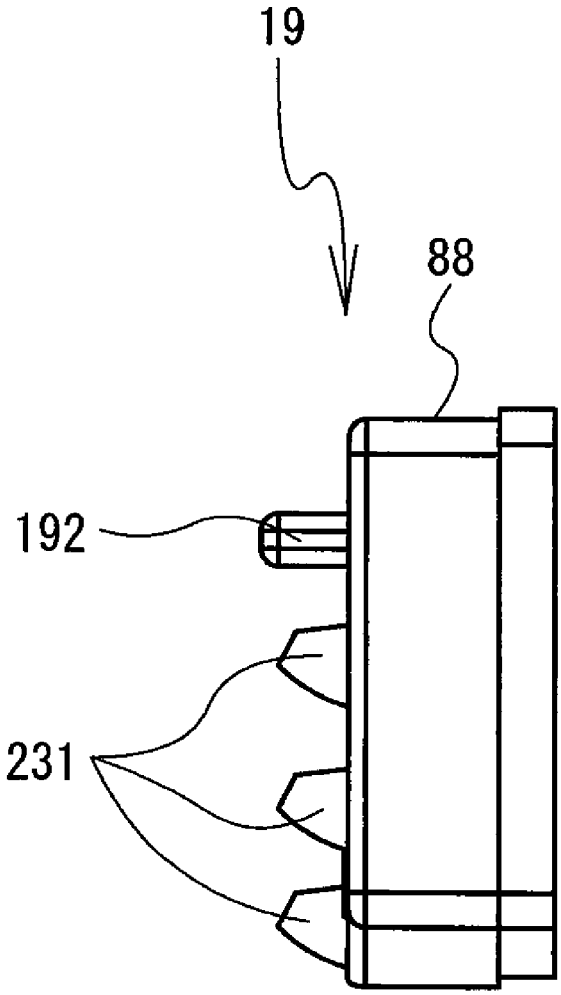
FIG. 13 is a right side view of the sensor holder 19.
Figure 14:
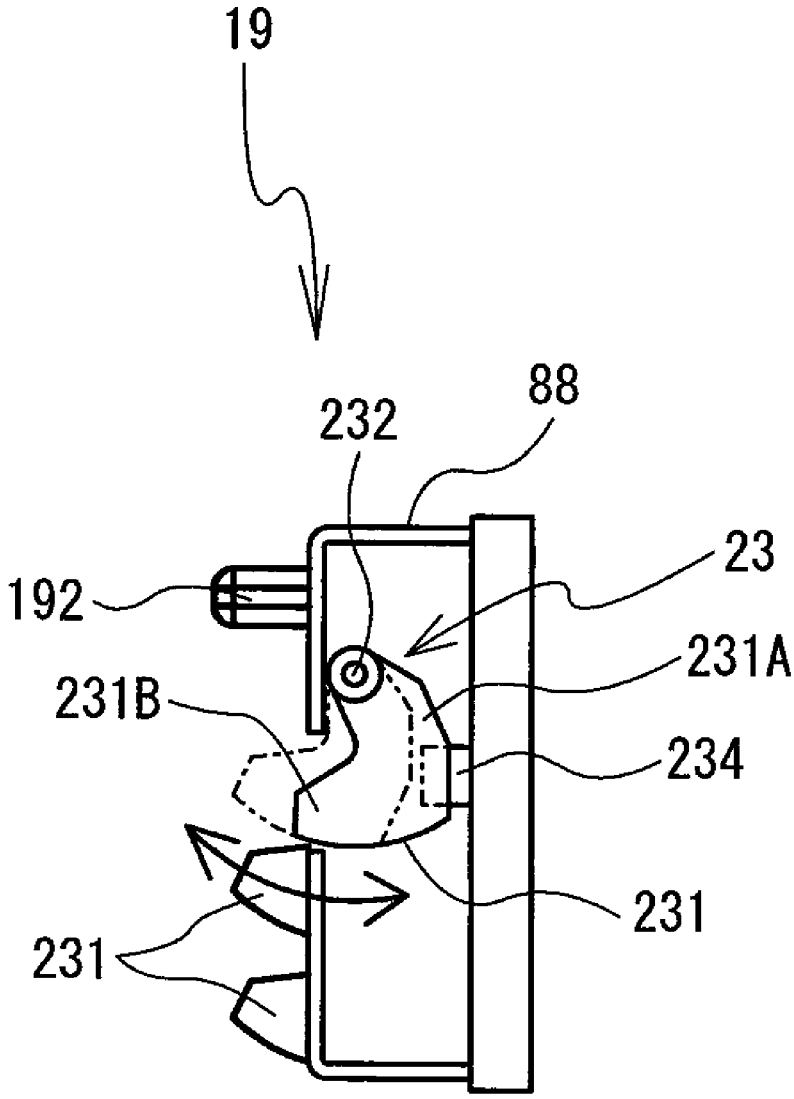
FIG. 14 is a longitudinal section view of the sensor holder 19 shown in FIG. 13.

As shown in FIG. 13 and FIG. 14, in the mechanical sensor 23, the switch terminals 231 are provided inside a low-profile box shaped sensor main body (not shown in the figures) that has a small length in the back-and-forth direction (in the left-and-rightward direction in FIG. 13 and FIG. 14). The switch terminal 231 is provided such that it can move rotationally in the back-and-forth direction where the center of rotational movement is a shaft portion 232 that extends inside the sensor main body in the left-and-rightward direction (in the back-and-forth direction in FIG. 13 and FIG. 14). The switch terminal 231 is constantly urged to move rotationally in the rearward direction (in the leftward direction in FIG. 13 and FIG. 14) by an urging spring (not shown in the figures) such that it moves to a protruding position. When external pressure is applied to the leading end of the switch terminal 231, the switch terminal 231 moves rotationally in the forward direction (in the rightward direction in FIG. 13 and FIG. 14), and thus moves to a retracted position. A detecting element 234 that detects a displacement state of the switch terminal 231 is provided to the front of the switch terminal 231.

The switch terminal 231 as a whole is a tabular member that has a flat surface portion which is curved as a general U shape in a side view. The switch terminal 231 includes an arm 231A and a protruding portion 231B. The arm 231A extends in a radial direction from the shaft portion 232. The protruding portion 231B protrudes in the rearward direction from the leading end of the arm 231A. The length of the protruding portion 231B in the vertical direction tapers from the arm 231A toward the rear, and the protruding portion 231B has a form that protrudes in a general V shape in a side view. When the switch terminal 231 is moved to the protruding position, the protruding portion 231B protrudes further to the rear than the cassette-facing surface 191A. At that time, the arm 231A is not in contact with the detecting element 234 and the mechanical sensor 23 is thus in an off state.

When external pressure is applied that presses a peripheral edge portion of the general V shape of the protruding portion 231B, the protruding portion 231B retracts in the forward direction. At that time, the arm 231A is in contact with the detecting element 234 and the mechanical sensor 23 is thus in an on state. In other words, the protruding portion 231B retracts in the forward direction not only when the protruding portion 231B is horizontally pressed from the rear side, but also when the protruding portion 231B is vertically pressed from the upward or the downward direction, and the mechanical sensor 23 is thus in the on state.

Figure 15:
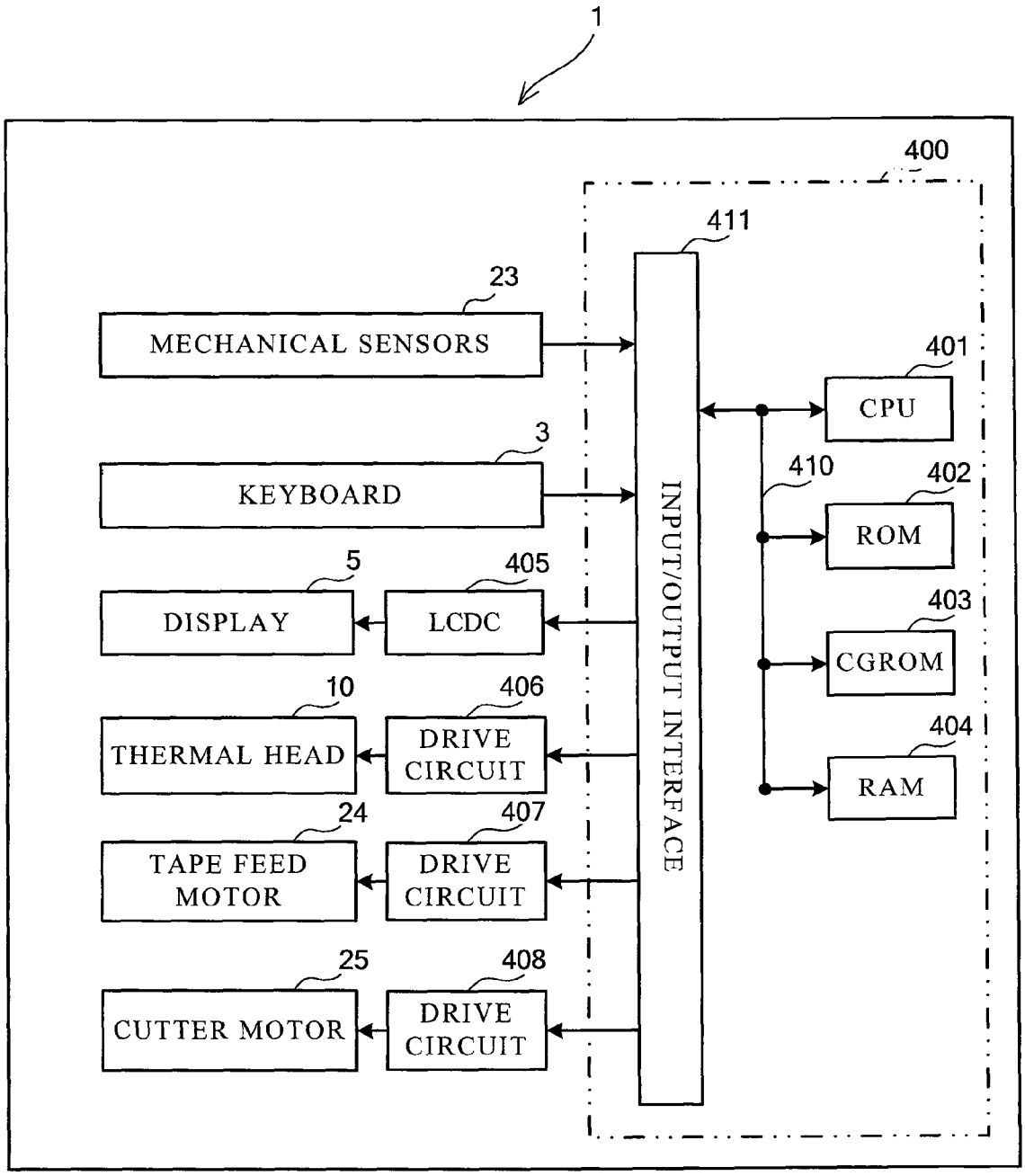
FIG. 15 is a block diagram illustrating the electrical structure of the printer 1.

The electrical configuration of the printer 1 will be explained with reference to FIG. 15. As shown in FIG. 15, the printer 1 includes a control circuit 400 formed on a control board. The control circuit 400 includes a CPU 401 that controls each instrument, a ROM 402, a CGROM 403, a RAM 404, and an input/output interface 411, all of which are connected to the CPU 401 via a data bus 410.

The ROM 402 stores various programs for the CPU 401 to control the printer 1. The ROM 402 also stores tables that are used to identify the tape type of the tape cassette 30 installed in the cassette housing portion 8. The CGROM 403 stores print dot pattern data to be used to print characters. The RAM 404 includes a plurality of storage areas, including a text memory, a print buffer and so on.

The input/output interface 411 is connected, respectively, to the mechanical sensors 23, the keyboard 3, a liquid crystal drive circuit (LCDC) 405 and drive circuits 406, 407 and 408 etc. The drive circuit 406 is en electronic circuit that drives the thermal head 10. The drive circuit 407 is an electronic circuit that drives a tape feed motor 24, which causes the ribbon take-up shaft 9 and the tape drive shaft 11 to rotate. The drive circuit 408 is an electronic circuit that drives a cutter motor 25, which operates a moving blade (not shown in the figures) that cuts the printed tape 50. The liquid crystal drive circuit (LCDC) 405 has a video RAM (not shown in the figures) to output display data to a display (LCD) 5.

Operating modes of the movable mechanism 100 will be explained in more detail with reference to FIG. 16 to FIG. 24. For ease of explanation of the operating modes of the movable mechanism 100, the wall 20 (refer to FIG. 9 and FIG. 10), the spring member 22 (refer to FIG. 9 and FIG. 10), the lever depression portion 61 provided on the cover 6, the support member 62 and the protruding piece 63 (refer to FIG. 2) are omitted in FIG. 16 to FIG. 24.

An operating mode of the movable mechanism 100 will be explained in a case in which the cover 6 is closed in the downward direction, and is thus moved from the open position (refer to FIG. 2) to the closed position (refer to FIG. 1).

Figure 16:
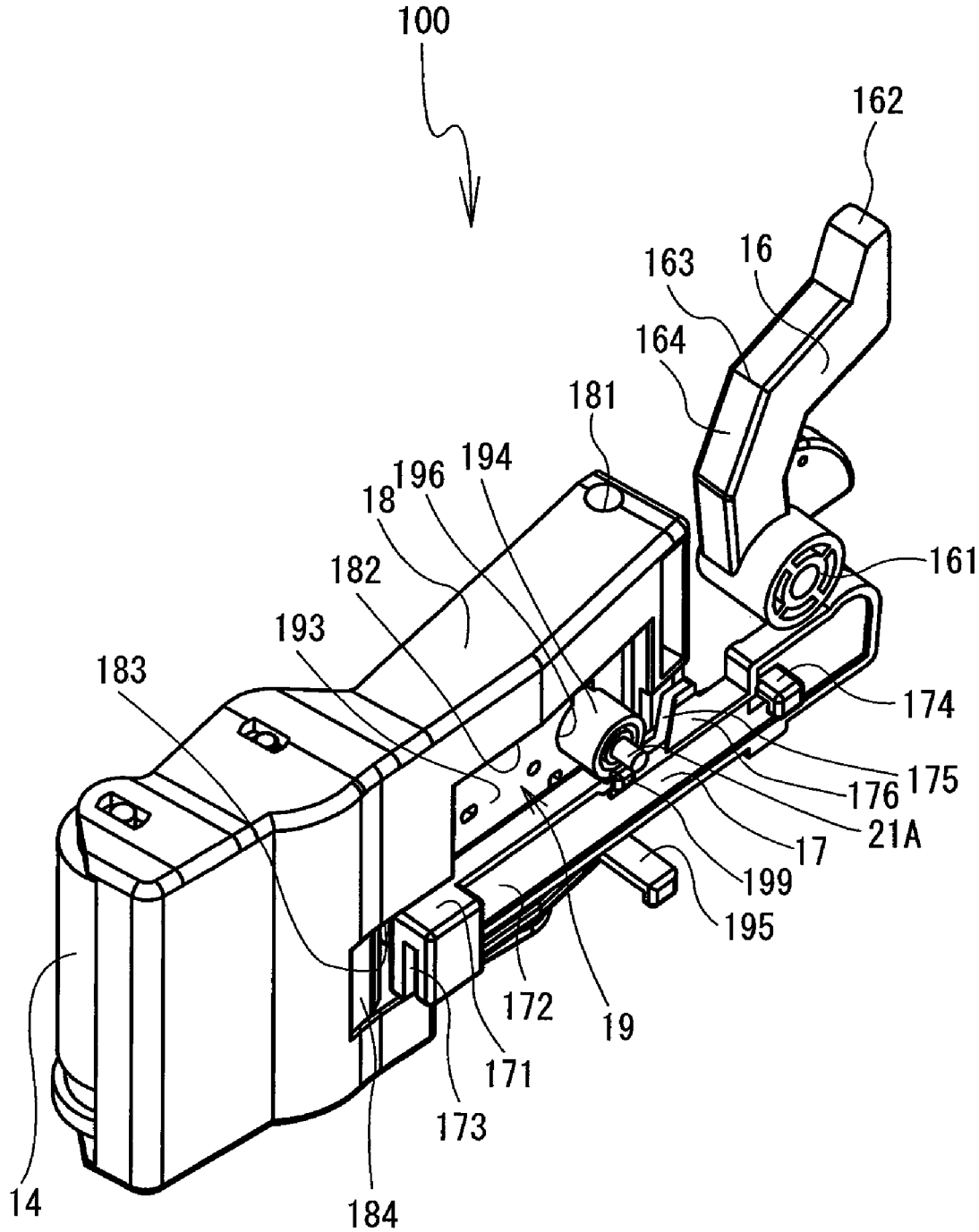
FIG. 16 is a perspective view as seen diagonally from the front of the movable mechanism 100 with the wall 20 removed and when the cassette cover 6 is opened.
Figure 17:
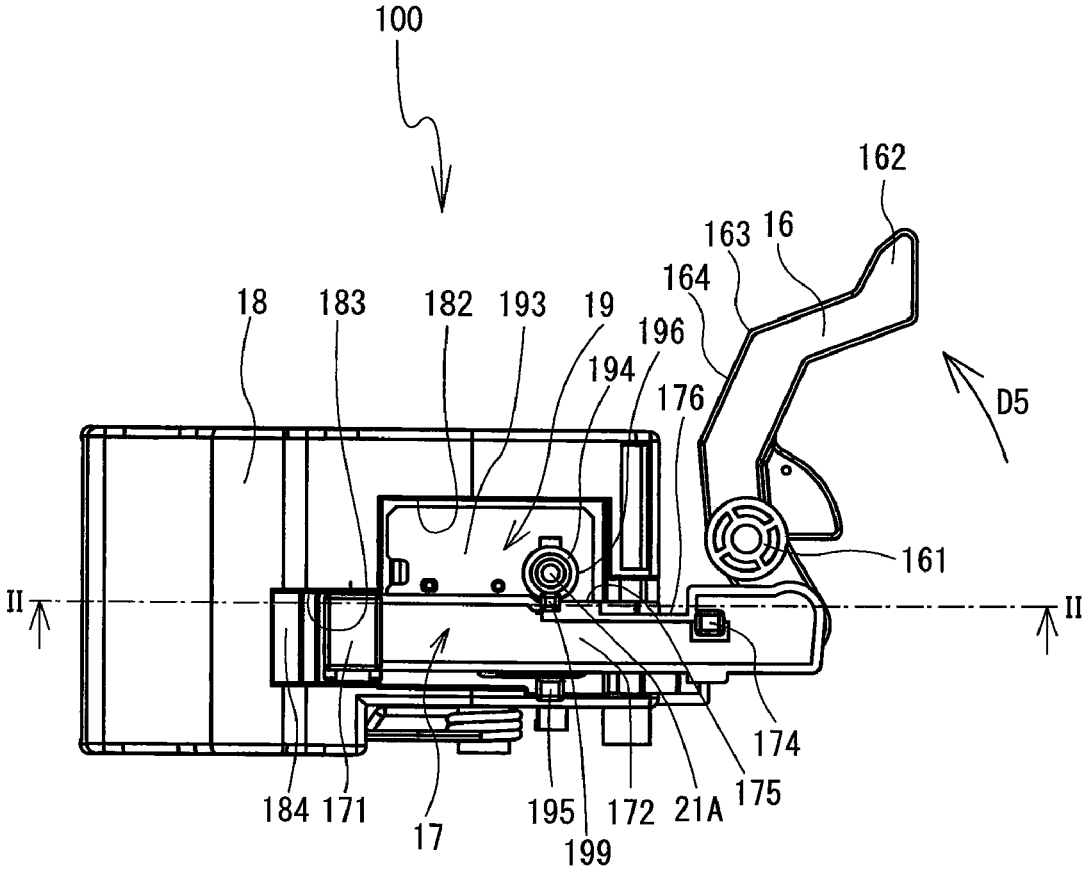
FIG. 17 is a front view of the movable mechanism 100 shown in FIG. 16.

As shown in FIG. 16 to FIG. 18, the lever 16 is urged in the upward direction (a rotational movement direction D5 in FIG. 17) by a lever spring (not shown in the figures). When the cover 6 is in the open position due to the urging force of the lever 16, the lever protrusion 162 is at its highest position. At that time, the release rod 17 that is coupled to the lower end of the lever 16 is at a right end position of the range of movement of the release rod 17.

As shown in FIG. 18, when the cover 6 is in the open position, the holder guide portion 199 is engaged with the first rod guide portion 1751. The sensor holder 19, which is urged in the rearward direction (in the downward direction in FIG. 18) by the spring member 22, is regulated to move by the first rod guide portion 1751 and it is maintained in a separated position (a position shown in FIG. 18). The holder side reception portion 184 of the roller holder 18 is separated from the depression portion 171 of the release rod 17. The roller holder 18 is not pressed by the depression portion 171, and is urged in the forward direction by the urging spring (not shown in the figures), thus being maintained in the stand-by position shown in FIG. 18.

When the cover 6 is closed by the user, pressure in the downward direction is applied to the cover 6 in the open position. In the process of the cover 6 moving toward the closed position in accordance with the downward pressure, the lever depression portion 61 (refer to FIG. 2) comes into contact with the lever protrusion 162 (refer to FIG. 16). The lever depression portion 61 depresses the lever protrusion 162 and thus the lever 16 resists the pressure of the lever spring (not shown in the figures) and moves rotationally in the downward direction. In accordance with the rotational movement of the lever 16, the release rod 17 moves from the right end position in the leftward direction. As the cover 6 moves further toward the closed position, the lever depression portion 61 (refer to FIG. 2) comes into contact with the top surface curved portion 163 of the lever 16.

By the lever depression portion 61 depressing the top surface curved portion 163, the lever 16 moves rotationally further in the downward direction, and the release rod 17 moves further in the leftward direction. In accordance with the movement of the release rod 17 in the leftward direction, the inclined surface 1712 of the depression portion 171 comes into contact with the holder side reception portion 184 of the roller holder 18. As the inclined surface 1712 depresses the holder side reception portion 184, the holder side reception portion 184 slides along the inclined surface 1712 and the roller holder 18 resists the urging force of the urging spring (not shown in the figures) and pivots in the rearward direction.

Figure 19:
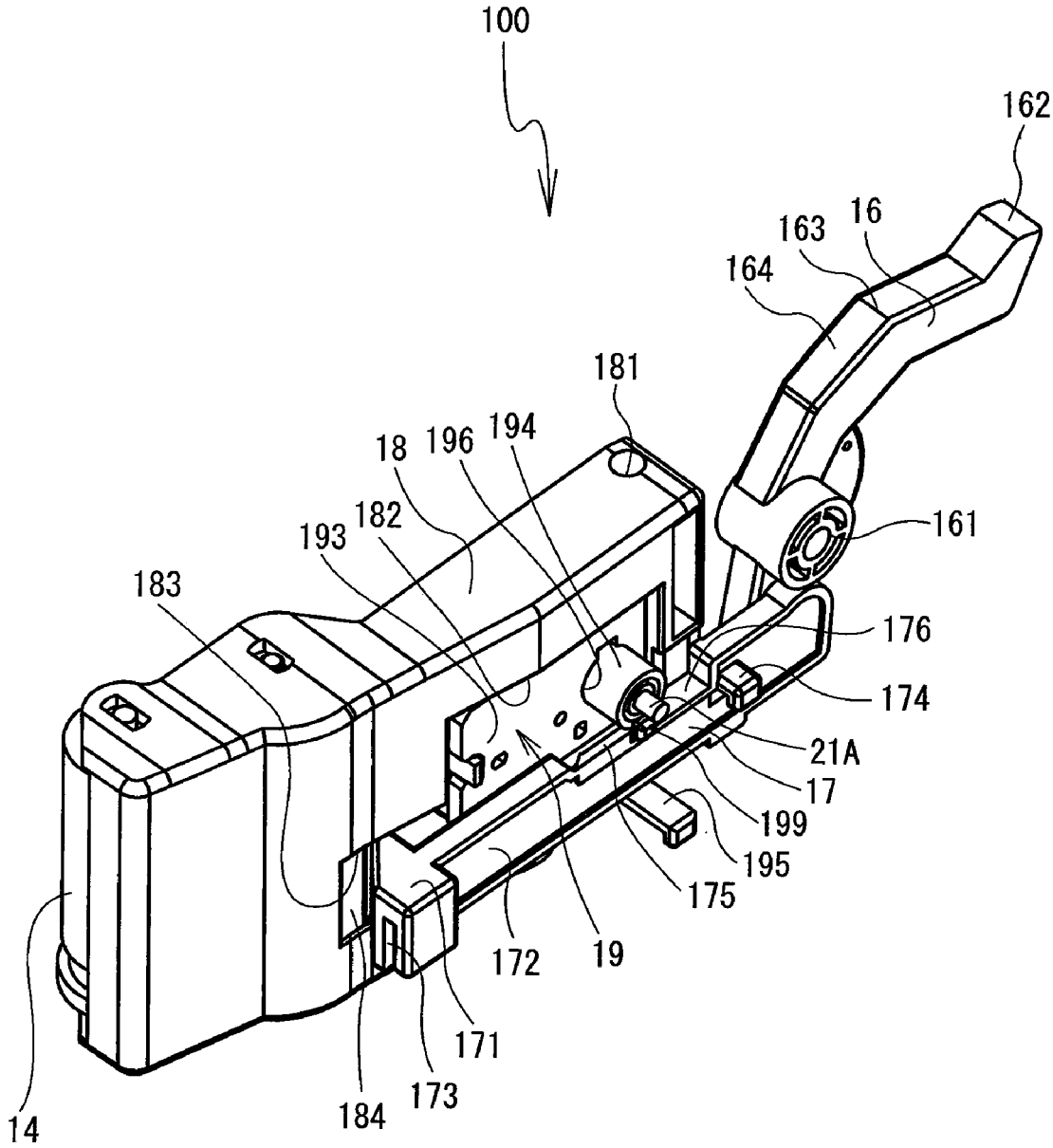
FIG. 19 is a perspective view of the movable mechanism 100 as seen diagonally from the front, when the cassette cover 6 is in a state of being opened and closed with the wall 20 removed.
Figure 20:
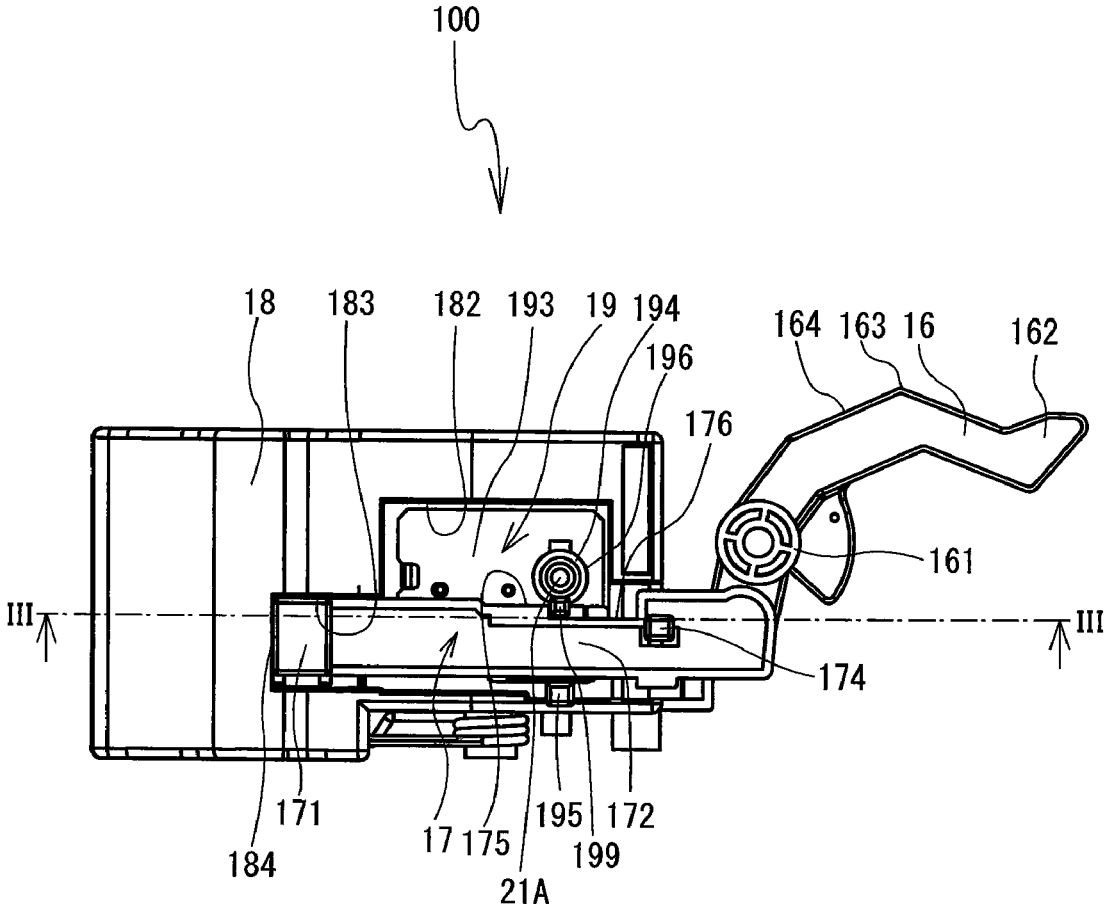
FIG. 20 is a front view of the movable mechanism 100 shown in FIG. 19.
Figure 21:
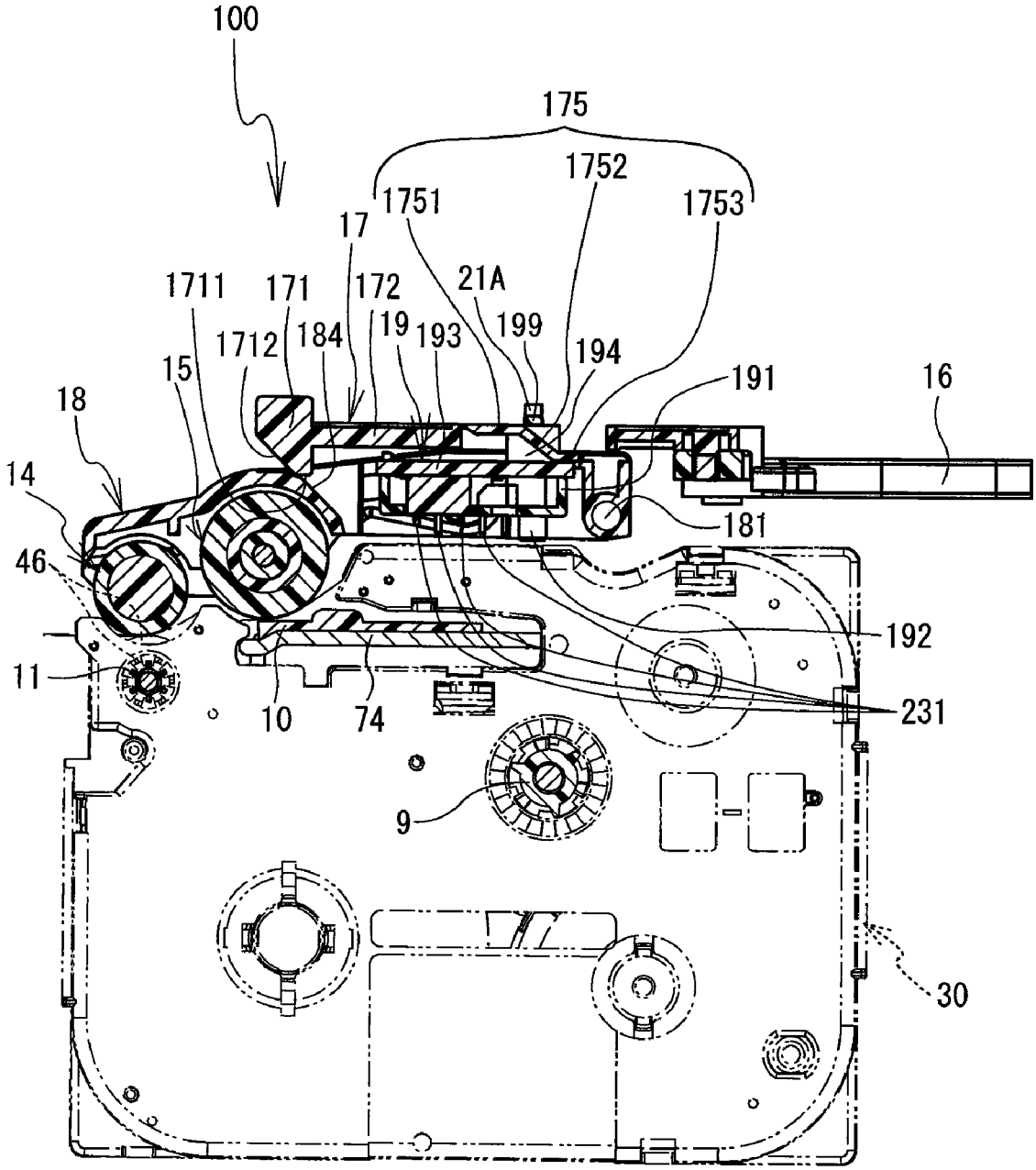
FIG. 21 is a diagram showing a cross-sectional view along a line shown in FIG. 20 as seen in the direction of the arrows, and also showing the tape cassette 30, the tape drive shaft 11 and the thermal head 10.

As shown in FIG. 19 to FIG. 21, when the release rod 17 reaches a first position (a position shown in FIG. 21), the tape cassette 30 is fixed inside the cassette housing portion 8 by the roller holder 18. More specifically, the platen roller 15 presses the thermal head 10 via the film tape 59 and the ink ribbon 60 positioned at the opening 77. The movable feed roller 14 presses the tape drive roller 46, which is inserted in the tape drive shaft 11, via the film tape 59 and the double-sided adhesive tape 58. A position in which the tape cassette 30 is fixed inside the cassette housing portion 8 (a position shown in FIG. 21) is a contact position of the roller holder 18.

The sensor holder 19, which is structured such that it can only move in the back-and-forth direction, does not move in the left-and-rightward direction. For that reason, in accordance with the movement of the release rod 17 in the left-and-rightward direction, the rod guide portion 175 slides in the left-and-rightward direction while maintaining its state of engagement with the holder guide portion 199. More specifically, when the release rod 17 moves in the leftward direction from the right end position to the first position, the first rod guide portion 1751 slides in the leftward direction while maintaining its state of engagement with the holder guide portion 199. The first rod guide portion 1751 is a wall portion that runs parallel to the left-and-rightward direction, and thus, in a state in which the first rod guide portion 1751 is engaged with the holder guide portion 199, even when the release rod 17 moves in the left-and-rightward direction, the sensor holder 19 does not move in the back-and-forth direction.

In this way, in accordance with the movement in the leftward direction of the release rod 17 from the right end position to the first position, the roller holder 18 pivots from the stand-by position (refer to FIG. 18) in the rearward direction. When the roller holder 18 reaches the contact position (refer to FIG. 21), the platen roller 15 is pressed by the thermal head 10 and the movable feed roller 14 is also pressed by the tape drive roller 46. As the sensor holder 19 is maintained in the separated position, the switch terminals 231 do not come into contact with the arm indicator portion 800 of the tape cassette 30.

From a state in which the cover 6 is partially closed (refer to FIG. 19 to FIG. 21), when the cover 6 is further moved toward the closed position, the lever depression portion 61 depresses the top surface curved portion 163. In accordance with the further rotational movement of the lever 16 in the downward direction, the release rod 17 moves from the first position even further in the leftward direction. When the cover 6 reaches the closed position, the lever depression portion 61 is in contact with the contact surface 164 of the lever 16. In this case, the release rod 17 moves to a second position (a position shown in FIG. 24), which is a left end of the range of movement of the release rod 17.

Figure 22:
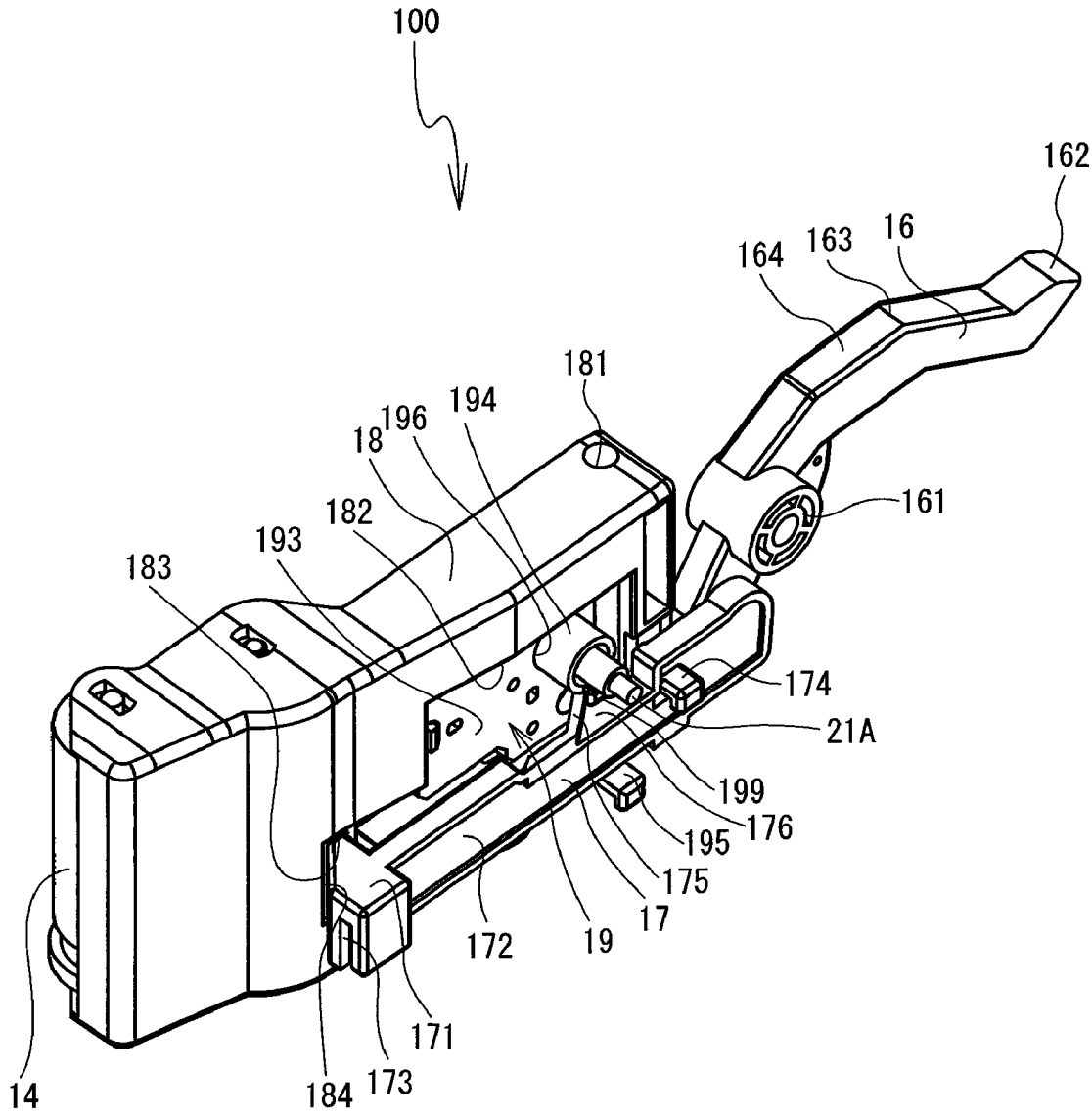
FIG. 22 is a perspective view of the movable mechanism 100 as seen diagonally from the front, when the cassette cover 6 is closed and with the wall 20 removed.
Figure 23:
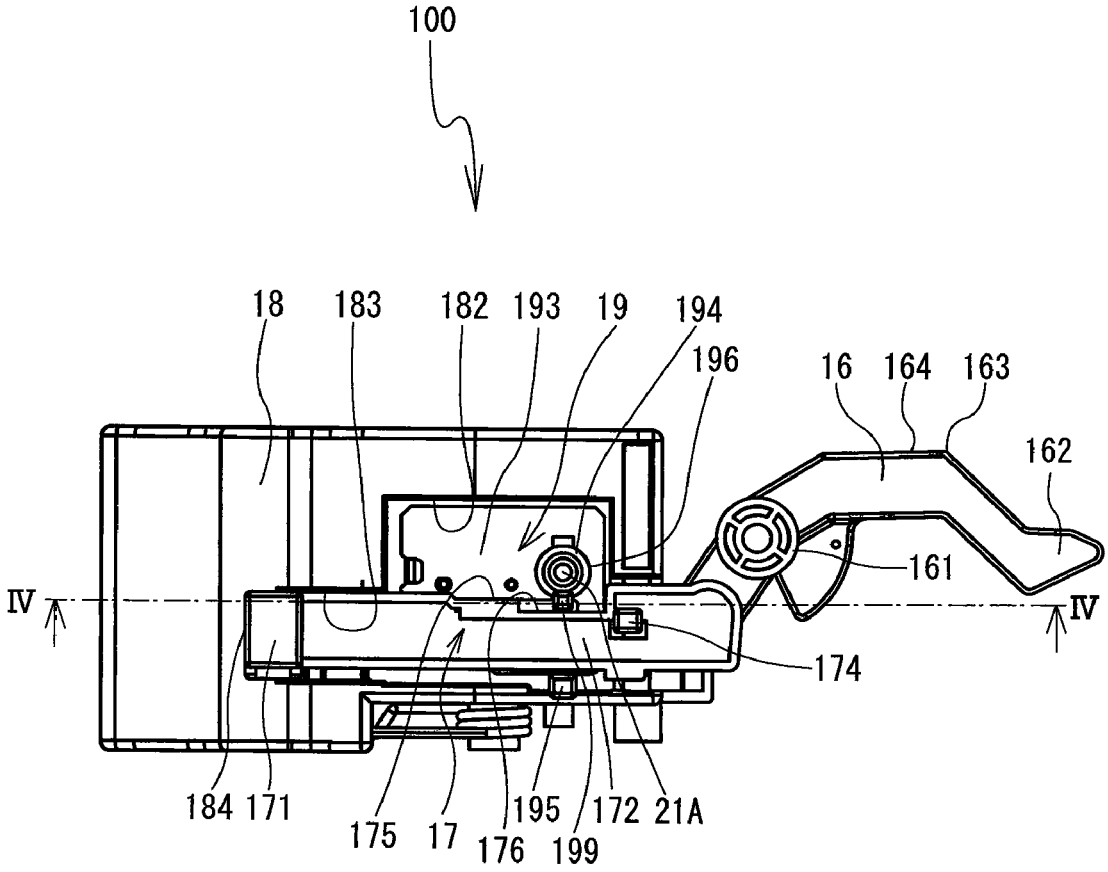
FIG. 23 is a front view of the movable mechanism 100 shown in FIG. 22.
Figure 24:
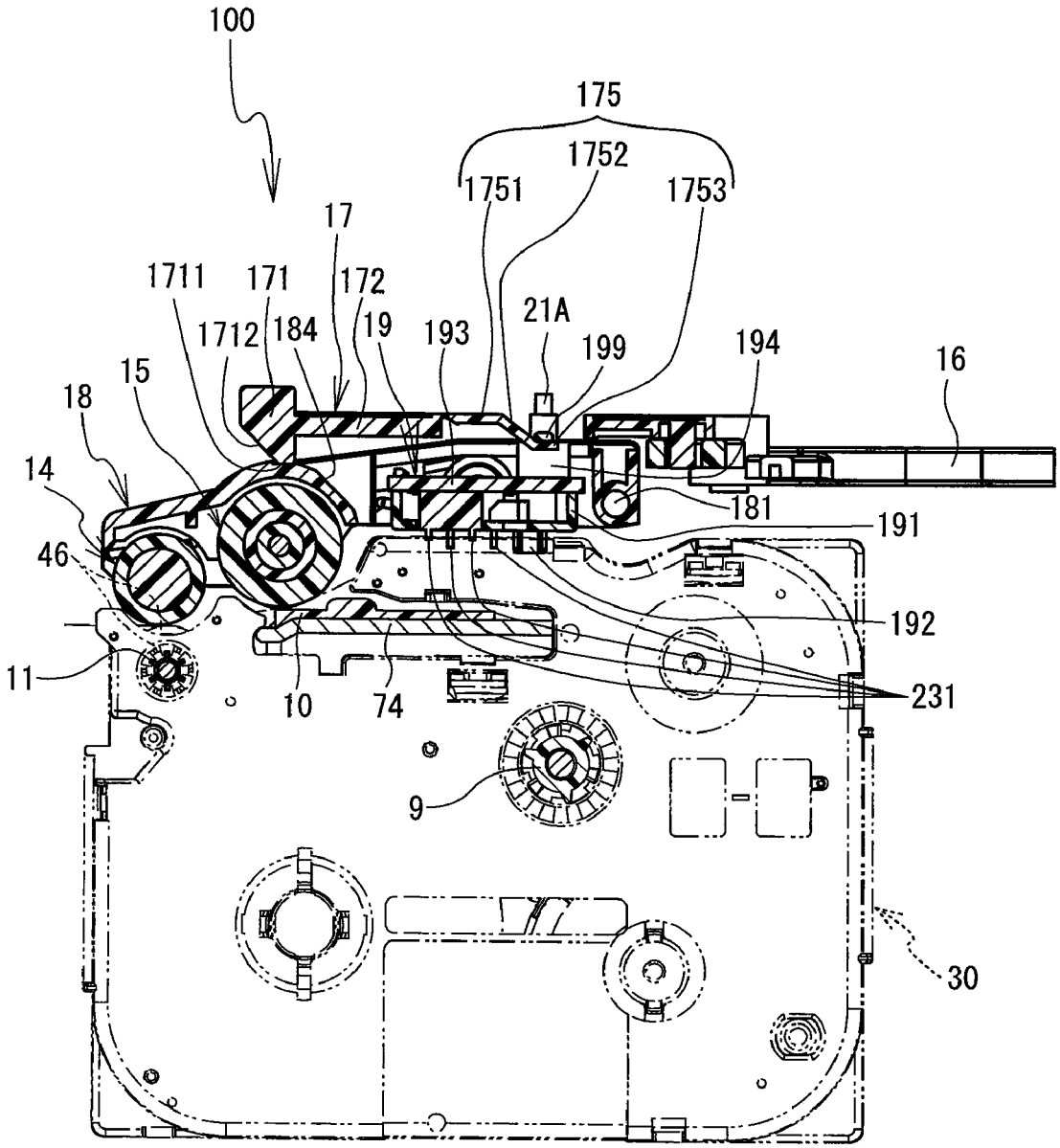
FIG. 24 is a diagram showing a cross-sectional view along a IV-IV line shown in FIG. 23 as seen in the direction of the arrows, and also showing the tape cassette 30, the tape drive shaft 11 and the thermal head 10.

In accordance with the movement of the release rod 17 further to the left side of the first position (refer to FIG. 21), the holder side reception portion 184 is further depressed in the rearward direction by the inclined surface 1712. As shown in FIG. 22 to FIG. 24, when the release rod 17 reaches the second position (refer to FIG. 24), the rear surface 1711 of the depression portion 171 comes into contact with the holder side reception portion 184. A position in which the holder side reception portion 184 is in contact with the rear surface 1711 (a position shown in FIG. 24) is a print position of the roller holder 18.

In this way, in concert with the movement of the cover 6 from the open position to the closed position, the roller holder 18 gradually moves in the rearward direction. As the cover 6 approaches the closed position, the pressure with which the platen roller 15 presses the thermal head 10 and the pressure with which the movable feed roller 14 presses the tape drive roller 46 gradually increase. In a state in which the roller holder 18 is in the print position (refer to FIG. 22 to FIG. 24), the tape cassette 30 is even more firmly fixed in the cassette housing portion 8 than when the roller holder 18 is in the contact position (refer to FIG. 21).

When the release rod 17 moves further in the leftward direction than the first position (refer to FIG. 21), the portion that is engaged with the holder guide portion 199 changes from the first rod guide portion 1751 to the rod guide inclined portion 1752. The rod guide inclined portion 1752, which is a wall that extends in the rearward direction to the right side of the first rod guide portion 1751, can slide while engaged with the holder guide portion 199. In this state, when the release rod 17 moves in the leftward direction, the holder guide portion 199 moves in the rearward direction along the rod guide inclined portion 1752 while being depressed by the spring member 22.

When the release rod 17 moves further in the leftward direction and reaches the second position (refer to FIG. 24), the portion that is engaged with the holder guide portion 199 changes from the rod guide inclined portion 1752 to the second rod guide portion 1753 (refer to FIG. 22 to FIG. 24). The second rod guide portion 1753 is a wall that extends parallel to the left-and-rightward direction and therefore, in a state in which the second rod guide portion 1753 is engaged with the holder guide portion 199, even if the release rod 17 moves in the left-and-rightward direction, the sensor holder 19 does not move in the back-and-forth direction. A position in which the sensor holder 19 is engaged with the second rod guide portion 1753 (a position shown in FIG. 24) is an identification position of the sensor holder 19.

As shown in FIG. 22 to FIG. 24, in a state in which the holder guide portion 199 has moved to the identification position, the latching piece 192 is inserted into the latching hole 820 of the tape cassette 30. The switch terminals 231 that are provided on the sensor holder 19 vertically oppose the arm indicator portion 800 of the tape cassette 30. The switch terminals 231 detect each of the indicators to which they are respectively opposed (the non-pressing portions 801 or the pressing portions 802). In this way, the CPU 401 that is provided in the printer 1 (refer to FIG. 15) can determine the tape type of the tape cassette 30.

As described above, when the cover 6 is in a closed state (refer to FIG. 22 to FIG. 24), the roller holder 18 moves to the print position and the sensor holder 19 also moves to the identification position. The printer 1 can perform stable and accurate printing, and can determine the tape type of the tape cassette 30.

Next, the operating mode of the movable mechanism 100 will be explained in a case in which the cover 6 is opened in the upward direction and is thus displaced from the closed position (refer to FIG. 1) to the open position (refer to FIG. 2). This operating mode is similar to when the cover 6 is closed in the downward direction, but the order of movement of the roller holder 18 and the sensor holder 19 is reversed.

Although not shown in FIG. 16 to FIG. 24, when the cover 6 is in the closed position (refer to FIG. 22 to FIG. 24), the protruding piece 63 of the cover 6 (refer to FIG. 2) is positioned below the lever protrusion 162 of the lever 16. When the cover 6 is opened in the upward direction from the closed position, the top surface of the protruding piece 63 pushes up the lever 16 in the upward direction. The pushed up lever 16 is urged to move rotationally in the upward direction by the lever spring (not shown in the figures). In accordance with the rotational movement of the lever 16, the release rod 17 moves from the second position (refer to FIG. 24) in the rightward direction.

When the release rod 17 moves from the second position (refer to FIG. 24) in the rightward direction, the holder guide portion 199 slides along the rod guide portion 175 (more specifically, the rod guide inclined portion 1752) in the forward direction. As the holder guide portion 199 slides in the forward direction, the sensor holder 19 moves from the identification position (refer to FIG. 24) in the forward direction and the switch terminals 231 are separated from the arm indicator portion 800. When the release rod 17 then moves in the rightward direction to a position further to the right of the first position (refer to FIG. 21), the sensor holder 19 is maintained in the separated position (refer to FIG. 18).

In accordance with the release rod 17 moving in the rightward direction from the second position (refer to FIG. 24) toward the first position (refer to FIG. 21), the holder side reception portion 184 slides in the forward direction along the depression portion 171 (more specifically, the inclined surface 1712) due to the urging spring (not shown in the figures). As the holder side reception portion 184 slides in the forward direction and as the roller holder 18 moves toward the contact position (refer to FIG. 21), the pressure that fixes the tape cassette 30 in place gradually weakens in comparison to when the roller holder 18 is in the print position (refer to FIG. 24). When the release rod 17 moves further in the rightward direction than the first position (refer to FIG. 21), the roller holder 18 slides further in the forward direction than the contact position (refer to FIG. 21). In this way, the platen roller 15 and the movable feed roller 14 are each separated from the thermal head 10 and the tape drive roller 46, respectively, and the roller holder 18 is maintained in the stand-by position (refer to FIG. 18).

As described above, when the cover 6 is in the open position (refer to FIG. 16 to FIG. 18), the roller holder 18 moves to the stand-by position, and the sensor holder 19 moves to the separated position. The movable feed roller 14 and the platen roller 15 do not interfere with the tape cassette 30 that is inserted into and removed from the cassette housing portion 8. The switch terminals 231 do not interfere with the tape cassette 30 that is inserted into and removed from the cassette housing portion 8. Thus, in the printer 1, the tape cassette 30 can be freely inserted into and removed from the cassette housing portion 8.

Modes of detecting the tape type of the tape cassette 30 installed in the cassette housing portion 8 will be explained with reference to FIG. 25 and FIG. 26.

Figure 25:
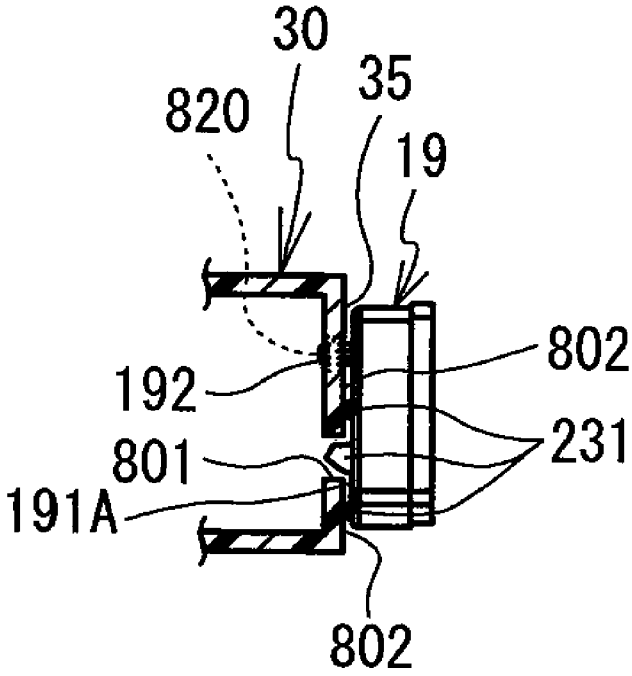
FIG. 25 is a cross-sectional view along a I-I line shown in FIG. 5 as seen in the direction of the arrows, showing a state in which the sensor holder 19 is pressed by the tape cassette 30 that is installed in a cassette housing portion 8 at a proper position.

As shown in FIG. 25, when the tape cassette 30 is installed at a proper position in the cassette housing portion 8, the cover 6 is closed (refer to FIG. 2) and the sensor holder 19 moves to the identification position, the latching piece 192 provided on the cassette-facing surface 191A is inserted into the latching hole 820 of the tape cassette 30. The mechanical sensors 23 provided on the cassette-facing surface 191A oppose the arm indicator portion 800 of the tape cassette 30. Each of the five switch terminals 231 are selectively pressed by the indicators (the non-pressing portions 801 and the pressing portions 802) of the arm indicator portion 800.

More specifically, with the wide-width tape cassette 30 shown in FIG. 5, the switch terminal 231 that opposes the pressing portion 802 is pressed by the surface portion of the arm front surface 35 and the mechanical sensor 23 is in the on state. The switch terminal 231 that opposes the non-pressing portion 801 is inserted into the non-pressing portion 801, and the mechanical sensor 23 is in the off state. With the narrow-width tape cassette 30 shown in FIG. 6 and FIG. 7, the mechanical sensor 23 is in the on state or the off state in a similar way to that described above, but the switch terminal 231 that opposes the escape hole 803 is not pressed and the mechanical sensor 23 is constantly in the off state.

Figure 26:
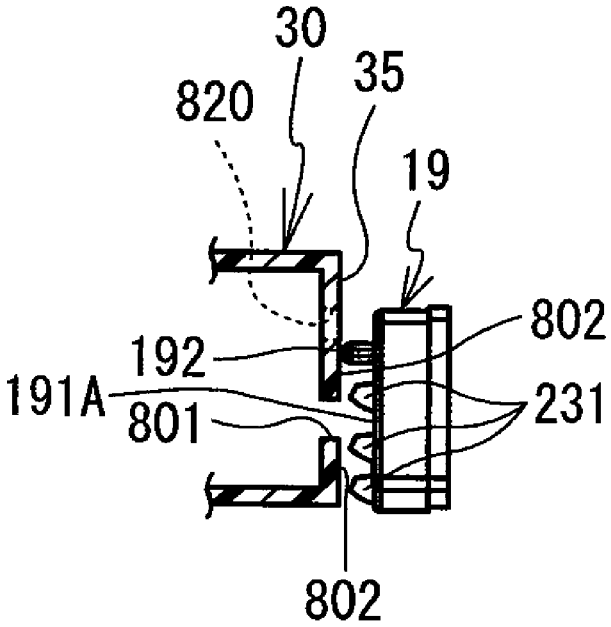
FIG. 26 is a cross-sectional view along the I-I line shown in FIG. 5 as seen in the direction of the arrows, showing a state in which the sensor holder 19 is pressed by the tape cassette 30 that is installed in the cassette housing portion 8 at an improper position.

As shown in FIG. 26, if the cassette case 30 is in a slightly displaced or raised position with respect to the proper position in the cassette housing portion 8, the tape cassette 30 is not installed in the cassette housing portion 8 at the proper position. In this case, when the cover 6 (refer to FIG. 2) is closed and the sensor holder 19 moves to the identification position, the latching piece 192 is not inserted into the latching hole 820 and comes into contact with the arm front surface 35. The latching piece 192 has a larger protrusion width (the length in the back-and-forth direction from the cassette-facing surface 191A) than the switch terminals 231. Accordingly, when the latching piece 192 comes into contact with the arm front surface 35, the switch terminals 231 do not come into contact with the arm front surface 35, and all the mechanical sensors 23 are in the off state.

In the printer 1, the tape type of the tape cassette 30 installed in the cassette housing portion 8 is identified based on a combination of the on and off states of the five mechanical sensors 23. More specifically, the tape type is identified by referring to tables stored in advance in the ROM 402 (refer to FIG. 15) in which the on and off state combinations of the mechanical sensors 23 correspond to the tape type. When all the mechanical sensors 23 are in the off state, it is identified that the tape cassette 30 is not installed in the cassette housing portion 8 at the proper position.

In the present embodiment, the arm indicator portion 800 is provided adjacent to the opening 77. It is possible for a person to simultaneously visually check, from the front, the arm indicator portion 800 and the tape type that is discharged from the opening 77. By providing the indicators of the arm indicator portion 800 such that they correspond to the tape type in accordance with predetermined rules, the person can visually check the arm indicator portion 800 and identify the tape type. The person can verify whether the identified tape type matches the tape type that is housed in the tape cassette 30 by referring to the tape type that is discharged from the opening 77.

As described above, in the printer 1 according to the present embodiment, the arm indicator portion 800 is provided on the arm front surface 35 of the tape cassette 30. The switch terminals 231 of the mechanical sensors 23 detect the tape type by being pressed by the arm indicator portion 800. In this way, in comparison with a case in which mechanical sensors are provided protruding toward a bottom surface of the tape cassette, it is possible to inhibit the occurrence of displacement in a tape print position that may be caused by the repulsive force of the switch terminals. Restrictions on space and positions in which the mechanical sensors are provided can be reduced.

When the cover 6 is closed, the roller holder 18 reaches the contact position before the sensor holder 19 reaches the identification position. In other words, the tape cassette 30 is fixed by the roller holder 18 before the switch terminals 231 are pressed by the arm indicator portion 800. When the cover 6 is opened, the sensor holder 19 moves from the identification position toward the separated position before the roller holder 18 moves from the contact position toward the stand-by position. Namely, the tape cassette 30 is released by the roller holder 18 after the switch terminals 231 are separated from the arm indicator portion 800. In this way, the tape cassette 30 is always fixed by the roller holder 18 when the sensor holder 19 comes into contact with and is separated from the tape cassette 30.

According to the printer 1 of the present embodiment, in a state in which the tape cassette 30 is fixed in the cassette housing portion 8, the switch terminals 231 are either pressed by or separated from the arm indicator portion 800. As a result, when the switch terminals 231 are pressed by or separated from the arm indicator portion 800, even if, for example, the user touches the tape cassette 30 with his or her hand, or abnormal vibrations are applied to the printer 1 etc., fluctuations in the position of the tape cassette 30 can be inhibited. It is thus possible to reduce damage etc. to the switch terminals 231, and to appropriately protect the mechanical sensors 23.

In addition, in the mechanical sensor 23 according to the present embodiment, when external pressure is applied such that the periphery of the protruding portion 231B is pressed, the switch terminal 231 retracts. As a result, even if the tape cassette 30 is, for example, installed or removed in an abnormal manner, a risk of damage to the switch terminal 231 is reduced. Even if the user intentionally touches the switch terminal 231 with a finger, a risk of damage to the switch terminal 231 is reduced.

If the mechanical sensor 23 according to the present embodiment is pressed from a direction other than the direction of protrusion and retraction of the switch terminal 231, the position of the leading end of the switch terminal 231 changes in accordance with the pressing direction. For example, if external pressure is applied to the periphery of the protruding portion 231B, the switch terminal 231 retracts. Damage or bending caused by the switch terminal 231 being unable to withstand pressure is therefore curbed. Even if other members come into contact with or the user touches the switch terminal 231 as described above, the switch terminal 231 retracts and damage etc. is therefore appropriately prevented. Furthermore, by adopting rotating bodies as the switch terminals, it is possible to appropriately protect the mechanical sensor without making the structure of the mechanical sensor more complex.

In accordance with the movement of the release rod 17, the roller holder 18 moves rotationally and the sensor holder 19 also moves. The roller holder 18 and the sensor holder 19 are independently operated by moving the release rod 17. It is not necessary for the printer 1 to be provided with separate members to operate the roller holder 18 and the sensor holder 19, respectively. As a result, the number of components of the printer 1 can be reduced and an increase in the size of devices can be avoided.

The release rod 17 moves in accordance with the opening and closing of the cover 6. When the cover 6 is opened, the tape cassette 30 can be inserted into and removed from the cassette housing portion 8. When the cover 6 is closed, printing can be performed by the thermal head 10 and the tape type can further be detected by the plurality of mechanical sensors 23. As a consequence, simply by opening and closing the cover 6, the user can cause the printer 1 to be in an optimum state for use corresponding to the state of the cover 6. Thus, operability of the printer 1 can be improved.

In the printer 1 according to the present embodiment, the sensor holder 19 that is provided with the mechanical sensors 23 can move independently of the roller holder 18. As a result, movability of the mechanical sensors 23 can be improved, and detection of the tape type can be appropriately performed. There is no restriction on the positions and number of the mechanical sensors 23, and thus the degree of freedom of design of the printer 1 can be improved, The switch terminals 231 are moved perpendicularly with respect to the arm indicator portion 800. Simply by causing the switch terminals 231 to move in the forward direction by the minimum necessary distance, they can be efficiently and sufficiently moved away such that they do not touch the tape cassette 30. As a consequence, the moving space required when causing the mechanical sensors 23 to retract can be minimized, thus avoiding an increase in the size of the printer 1 and increasing the degree of freedom of design of the printer 1.

The sensor holder 19 that is provided with the mechanical sensors 23 is provided between the shaft support 181 that is the pivot center of the roller holder 18 and the platen roller 15. As the sensor holder 19 is provided within the installation space of the roller holder 18, it is not necessary to secure a separate installation space for the sensor holder 19. As a result, the sensor holder 19 that operates independently from the roller holder 18 can be provided without any increase in the size of the printer 1, thus increasing the space-saving capabilities and the degree of freedom of design of the housing.

Note that the printer 1 of the present disclosure is not limited to that in the above-described embodiment, and various modifications and alterations may of course be made insofar as they are within the scope of the present invention.

Figure 27:
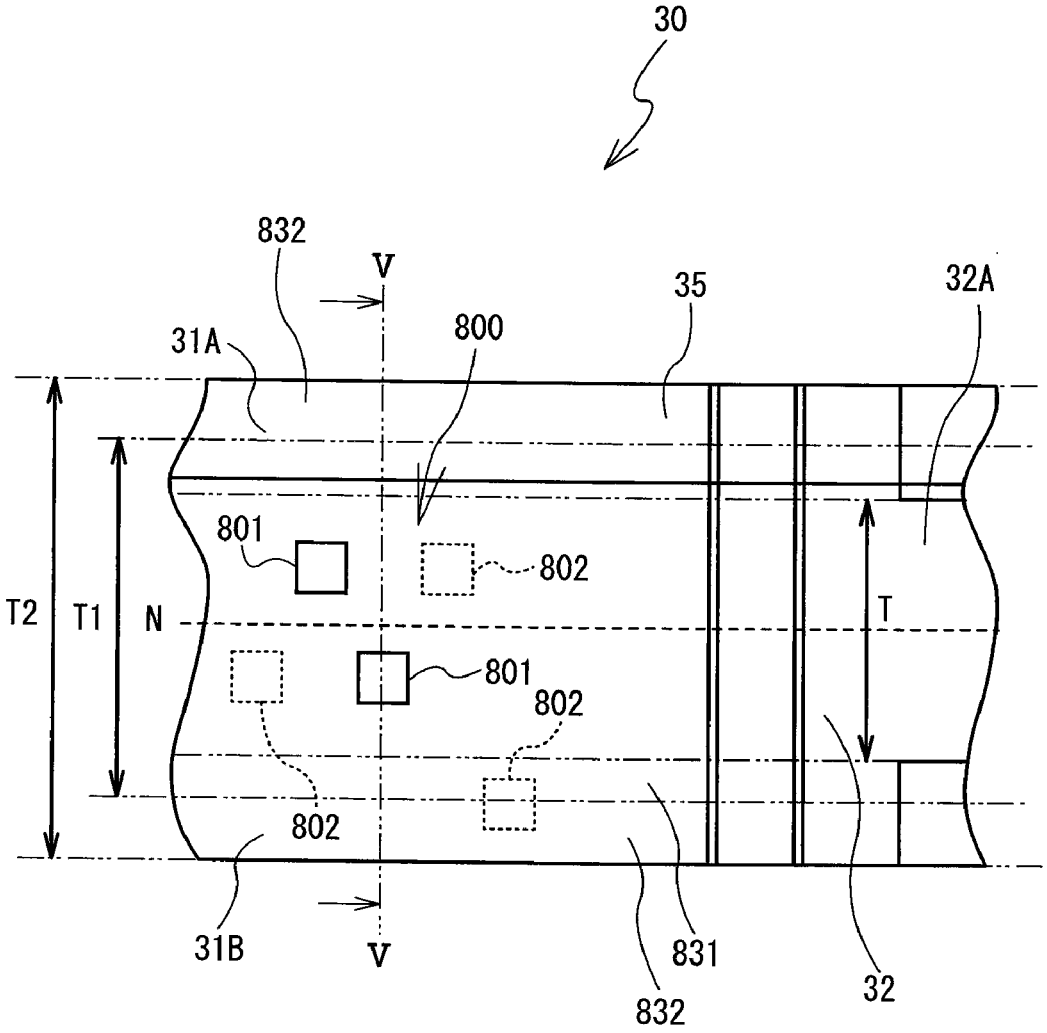
FIG. 27 is an enlarged front view of the arm front surface 35 of the wide-width tape cassette 30 of a modified example.
Figure 28:
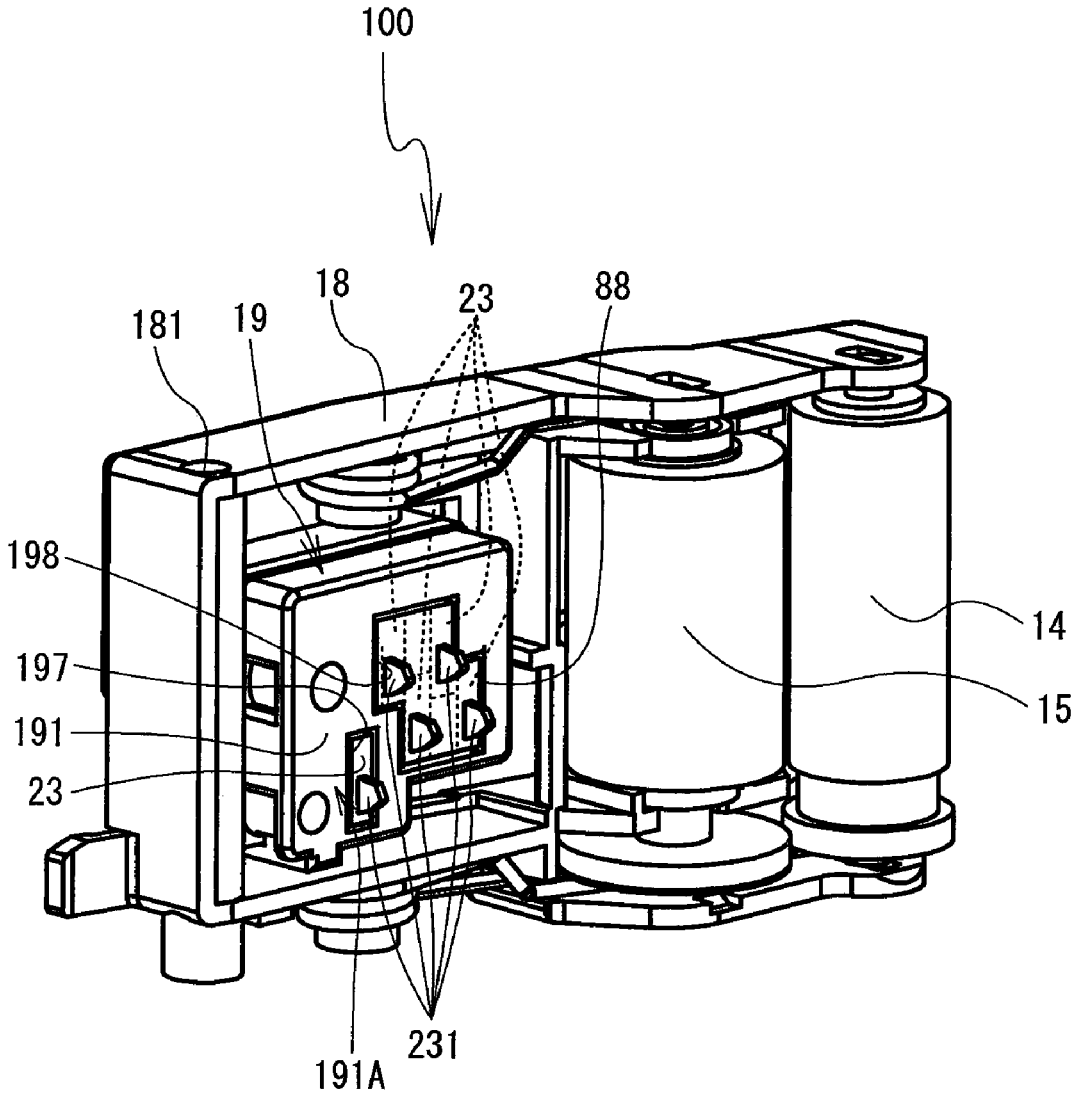
FIG. 28 is a perspective view seen diagonally from the rear of the roller holder 18 and the sensor holder 19 of the modified example.
Figure 29:
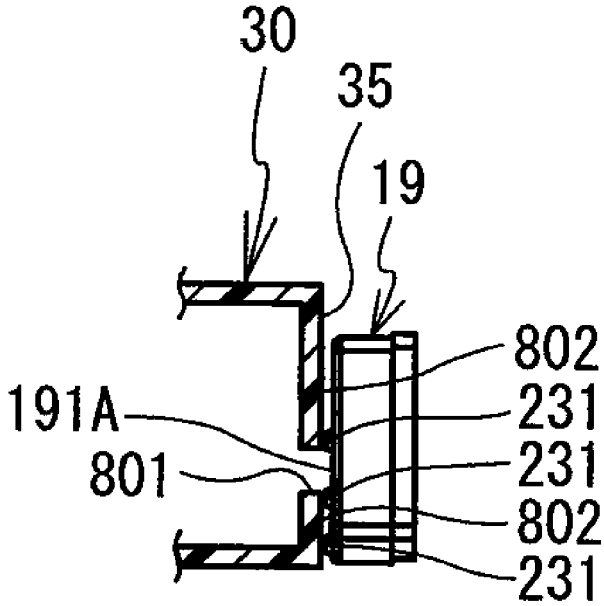
FIG. 29 is a cross-sectional view along a V-V line shown in FIG. 27 as seen in the direction of the arrows, showing a state in which the sensor holder 19 is pressed by the tape cassette 30 that is installed in the cassette housing portion 8 at an improper position.

As shown in FIG. 27 to FIG. 29, a structure may be adopted in which the latching hole 820 of the arm front surface 35 (refer to FIG. 5) and the latching piece 192 of the sensor holder 19 (refer to FIG. 11) are not provided. In this case, as long as the tape cassette 30 is installed in the cassette housing portion 8 at the proper position, in a similar manner to the above-described embodiments, the five switch terminals 231 are selectively pressed by the indicators of the arm indicator portion 800 that oppose each of the switch terminals 231 respectively (refer to FIG. 25).

As the direction of insertion and removal of the tape cassette 30 is in the vertical direction, when the tape cassette 30 is in a displaced or raised position with respect to the proper position in the cassette housing portion 8, in many cases, the tape cassette 30 is displaced in the upward direction with respect to the proper position. As described above, the plurality of switch terminals 231 are arranged in positions that correspond, respectively to the indicators of the arm indicator portion 800 and are arranged in a zigzag pattern such that none of the switch terminals 231 are aligned with each other in the vertical direction. As none of the indicators overlap in the vertical direction, when displacement of the tape cassette 30 occurs in the upward direction and the tape cassette 30 is raised with respect to the proper position, each of the switch terminals 231 does not detect another of the indicators, is pressed by a surface portion of the arm front surface 35 and is thus in the on state. In other words, even if there are fluctuations in the position of the tape cassette 30 installed in the cassette housing portion 8, the above structure prevents another of the switch terminals 231 from being inserted into the non-pressing portion 801 corresponding to a given one of the switch terminals 231, thus preventing mistaken identification of the tape type.

More specifically, as shown in FIG. 29, when the wide-width tape cassette 30 is raised or has positional displacement, if the cover 6 (refer to FIG. 2) is closed and the sensor holder 19 moves to the identification position, all the switch terminals 231 are pressed by a surface of the arm front surface 35 and are thus in the on state. When the narrow-width tape cassette 30 is installed in the cassette housing portion 8 and when the narrow-width tape cassette 30 is raised or has positional displacement, apart from the switch terminal 231 that is in a position that opposes the escape hole 803, the other four switch terminals 231 are pressed by the surface of the arm front surface 35 and are thus in the on state. In these cases with the printer 1, namely when all the mechanical sensors 23 are in the on state and also when four of the switch terminals 231 excepting the switch terminal 231 that opposes the escape hole 803 are in the on state, it may be identified that the tape cassette 30 is not installed at the proper position.

With the structure shown in FIG. 27 to FIG. 29, there is no engaging effect between the latching hole 820 and the latching piece 192, as described above. In this case, when the tape cassette 30 is inserted or removed, there is a risk that the periphery of the cassette case 31 may come into contact with the switch terminals 231 from above or below, or that there may be positional fluctuations of the tape cassette 30 installed in the cassette housing portion 8. With the mechanical sensor 23 according to the present embodiment, when external pressure is applied such that it presses the periphery of the protruding portion 231B, the switch terminal 231 retracts. Even when the latching hole 820 and the latching piece 192 are not provided, damage etc. to the switch terminal 231 can be appropriately prevented.

The structure of the mechanical sensor 23 is not limited to the above-described embodiment. For example, the switch terminal 231 may be an elastic body, such as a rubber body or a spiral spring etc., or may be a shaft that can protrude and retract in the back-and-forth direction. In this case, even if external pressure is applied to the switch terminal 231, for example, from above or below, damage etc. to the switch terminal 231 is prevented by the switch terminal 231 deforming elastically in response to the external pressure.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a cassette housing portion into which a tape cassette is detachably installed in a vertical direction, the tape cassette having a box-shaped cassette case in which is mounted a tape, and a side surface of the cassette case having an indicator portion that indicates a type of the tape;

a feeding device that feeds the tape mounted in the tape cassette that is installed in the cassette housing portion along a feed path;

a printing head that performs printing on the tape that is fed by the feeding device;

a platen roller that is located facing the printing head and is pressed against the printing head via the tape;

a roller holder that rotatably supports the platen roller and that is capable of moving rotationally between a first position and a second position around a shaft, the first position being a position in which the roller holder extends along the side surface of the tape cassette installed in the cassette housing portion and in which the platen roller presses the printing head via the tape, and the second position being a position in which the platen roller is separated from the printing head, the shaft being parallel to a direction of insertion and removal of the tape cassette;

a mechanical sensor having a switch terminal that is capable of protruding and retracting;

a sensor holder that holds the mechanical sensor between the shaft of the roller holder and the platen roller and that is capable of moving independently of the roller holder between a third position and a fourth position, the third position being a position in which the sensor holder presses the mechanical sensor against the indicator portion of the tape cassette installed in the tape cassette housing portion, and the fourth position being a position in which the sensor holder separates the mechanical sensor from the indicator portion; and a determination device that determines the type of the tape based on protrusion and retraction of the switch terminal of the mechanical sensor.

2. The printer according to claim 1, wherein:

the sensor holder is capable of moving in parallel to a direction of protrusion of the switch terminal and perpendicularly with respect to the side surface of the tape cassette installed in the tape cassette housing portion; and when the sensor holder moves toward the side surface, the switch terminal is perpendicularly pressed against the indicator portion; and when the sensor holder moves in an opposite direction away from the side surface, the switch terminal is perpendicularly separated from the indicator portion.

3. The printer according to claim 1, wherein:

when the sensor holder moves to the third position, the roller holder moves rotationally to the first position before the mechanical sensor is pressed against the indicator portion; and when the sensor holder moves to the fourth position, the roller holder moves rotationally to the second position after the mechanical sensor is separated from the indicator portion.

4. The printer according to claim 1, further comprising:

a rod portion that is respectively coupled to the roller holder and the sensor holder and that is capable of moving, wherein:

in accordance with the rod portion moving in a first direction, the rod portion causes the roller holder to move rotationally toward the first position, and also causes the sensor holder to move toward the third position; and in accordance with the rod portion moving in a second direction that is a different direction to the first direction, the rod portion causes the roller holder to move rotationally toward the second position and also causes the sensor holder to move toward the fourth position.

5. The printer according to claim 4, further comprising:

a cover that opens and closes the cassette housing portion, wherein:

the cover causes the rod portion to move in the first direction in linkage with a closing operation of the cover and causes the rod portion to move in the second direction in linkage with an opening operation of the cover.

6. The printer according to claim 1, further comprising:

a cover that opens and closes the cassette housing portion, wherein:

the roller holder moves rotationally toward the first position in linkage with a closing operation of the cover and moves rotationally toward the second position in linkage with an opening operation of the cover; and the sensor holder moves toward the third position in linkage with the closing operation of the cover and moves toward the fourth position in linkage with the opening operation of the cover.

7. The printer according to claim 1, wherein:

the indicator portion formed in a pattern corresponding to the type of the tape and includes at least one aperture;

the mechanical sensor constantly urges the switch terminal toward the side surface to protrude; and when the mechanical sensor is pressed against the indicator portion and the switch terminal is inserted into the aperture, a state of protrusion of the switch terminal is maintained;

when the switch terminal is pressed in an opposite direction to the direction of protrusion, the switch terminal retracts in the opposite direction away from the side surface; and when the switch terminal is pressed from a direction that is different to the opposite direction, a leading end position of the switch terminal changes corresponding to a pressing direction.

8. The printer according to claim 7, wherein:

the switch terminal is a rotating body whose center of rotation is in a direction that intersects with the direction of protrusion of the switch terminal; and when the switch terminal is pressed from a direction that is different to the opposite direction, the switch terminal moves rotationally in accordance with the pressing direction.

9. The printer according to claim 7, wherein:

the mechanical sensor is provided in a plurality on the sensor holder and the switch terminal is provided in a plurality;

a line linking one of the switch terminals to another of the switch terminals intersects with the vertical direction; and the aperture is provided in at least one position corresponding to the plurality of the switch terminals.

10. A printer, comprising:

a tape cassette including a box-shaped cassette case having a top surface, a bottom surface, a front surface and a pair of side surfaces, a tape that is mounted in the cassette case, and an indicator portion that is provided on the front surface and that indicates a type of the tape;

a cassette housing portion into which the tape cassette is detachably installed in a vertical direction;

a feeding device that feeds the tape mounted in the tape cassette that is installed in the cassette housing portion along a feed path;

a printing head that performs printing on the tape that is fed by the feeding device;

a platen roller that is located facing the printing head and is pressed against the printing head via the tape;

a roller holder that rotatably supports the platen roller and that is capable of moving rotationally around a shaft, the shaft being parallel to a direction of insertion and removal of the tape cassette;

a mechanical sensor having a switch terminal that is capable of protruding and retracting;

a sensor holder that holds the mechanical sensor between the shaft of the roller holder and the platen roller and that is capable of moving independently of the roller holder; and a determination device that determines the type of the tape based on protrusion and retraction of the switch terminal of the mechanical sensor;

wherein:

the cassette case includes:

a discharge portion that is provided along the feed path and that discharges the tape that is fed by the feeding device from the cassette case; and an exposure portion that exposes one surface of the tape in a direction opposite to the front surface while the other surface of the tape faces the printing head;

the indicator portion is provided in a position adjacent to the exposure portion on the front surface of the tape cassette and includes at least one aperture formed in a pattern corresponding to the type of the tape;

the roller holder is capable of moving rotationally between a first position and a second position, the first position being a position in which the roller holder extends along the front surface of the tape cassette installed in the cassette housing portion and in which the platen roller presses the printing head via the tape, and the second position being a position in which the platen roller is separated from the printing head; and the sensor holder is capable of moving between a third position and a fourth position, the third position being a position in which the sensor holder presses the mechanical sensor against the indicator portion of the tape cassette installed in the tape cassette housing portion, and the fourth position being a position in which the sensor holder separates the mechanical sensor from the indicator portion.

11. The printer according to claim 10, wherein:

the sensor holder is capable of moving in parallel to a direction of protrusion of the switch terminal and perpendicularly with respect to the front surface of the tape cassette installed in the tape cassette housing portion; and when the sensor holder moves toward the front surface, the switch terminal is perpendicularly pressed against the indicator portion; and when the sensor holder moves in an opposite direction away from the front surface, the switch terminal is perpendicularly separated from the indicator portion.

12. The printer according to claim 10, wherein:

when the sensor holder moves to the third position, the roller holder moves rotationally to the first position before the mechanical sensor is pressed against the indicator portion; and when the sensor holder moves to the fourth position, the roller holder moves rotationally to the second position after the mechanical sensor is separated from the indicator portion.

13. The printer according to claim 10, further comprising:

a rod portion that is respectively coupled to the roller holder and the sensor holder and that is capable of moving, wherein:

in accordance with the rod portion moving in a first direction, the rod portion causes the roller holder to move rotationally toward the first position, and also causes the sensor holder to move toward the third position; and in accordance with the rod portion moving in a second direction that is a different direction to the first direction, the rod portion causes the roller holder to move rotationally toward the second position and also causes the sensor holder to move toward the fourth position.

14. The printer according to claim 13, further comprising:

a cover that opens and closes the cassette housing portion, wherein:

the cover causes the rod portion to move in the first direction in linkage with a closing operation of the cover and causes the rod portion to move in the second direction in linkage with an opening operation of the cover.

15. The printer according to claim 10, further comprising:

a cover that opens and closes the cassette housing portion, wherein:

the roller holder moves rotationally toward the first position in linkage with a closing operation of the cover and moves rotationally toward the second position in linkage with an opening operation of the cover; and the sensor holder moves toward the third position in linkage with the closing operation of the cover and moves toward the fourth position in linkage with the opening operation of the cover.

16. The printer according to claim 10, wherein:

the indicator portion formed in a pattern corresponding to the type of the tape and includes at least one aperture;

the mechanical sensor constantly urges the switch terminal toward the front surface to protrude; and when the mechanical sensor is pressed against the indicator portion and the switch terminal is inserted into the aperture, a state of protrusion of the switch terminal is maintained;

when the switch terminal is pressed in an opposite direction to the direction of protrusion, the switch terminal retracts in the opposite direction away from the front surface; and when the switch terminal is pressed from a direction that is different to the opposite direction, a leading end position of the switch terminal changes corresponding to a pressing direction.

17. The printer according to claim 16, wherein:

the switch terminal is a rotating body whose center of rotation is in a direction that intersects with the direction of protrusion of the switch terminal; and when the switch terminal is pressed from a direction that is different to the opposite direction, the switch terminal moves rotationally in accordance with the pressing direction.

18. The printer according to claim 16, wherein:

the mechanical sensor is provided in a plurality on the sensor holder and the switch terminal is provided in a plurality;

a line linking one of the switch terminals to another of the switch terminals intersects with the vertical direction; and the aperture is provided in at least one position corresponding to the plurality of the switch terminals.

* * * * *